US011414803B2

(12) United States Patent
Jeon et al.

(10) Patent No.: US 11,414,803 B2
(45) Date of Patent: Aug. 16, 2022

(54) WASHING MACHINE

(71) Applicant: LG Electronics Inc., Seoul (KR)

(72) Inventors: Hoil Jeon, Seoul (KR); Hyewon Kim, Seoul (KR); Miju Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/962,283

(22) PCT Filed: Jan. 15, 2019

(86) PCT No.: PCT/KR2019/000575

§ 371 (c)(1),
(2) Date: Jul. 15, 2020

(87) PCT Pub. No.: WO2019/139448

PCT Pub. Date: Jul. 18, 2019

(65) Prior Publication Data

US 2021/0062388 A1 Mar. 4, 2021

(30) Foreign Application Priority Data

Jan. 15, 2018 (KR) ..... 10-2018-0005236
Mar. 29, 2018 (KR) ..... 10-2018-0036530

(51) Int. Cl.
*D06F 37/16* (2006.01)
*D06F 23/04* (2006.01)
(Continued)

(52) U.S. Cl.
CPC ..... *D06F 37/16* (2013.01); *D06F 23/04* (2013.01); *D06F 31/00* (2013.01); *D06F 37/24* (2013.01)

(58) Field of Classification Search
None
See application file for complete search history.

(56) References Cited

U.S. PATENT DOCUMENTS 4,829,792 A * 5/1989 Keith ..... D06F 31/005 68/58
5,318,328 A * 6/1994 Dawson ..... F16L 37/004 285/903
(Continued)

FOREIGN PATENT DOCUMENTS

KR 1020000024965 5/2000
KR 20110131210 12/2011
(Continued)

OTHER PUBLICATIONS

International Search Report in International Appln. No. PCT/KR2019/000575, dated May 17, 2019, 5 pages (with English translation).
(Continued)

*Primary Examiner* — Cristi J Tate-Sims
(74) *Attorney, Agent, or Firm* — Fish & Richardson P.C.

(57) ABSTRACT

A washing machine includes a drum rotated about a vertical axis, and opened at a top thereof, a ring-shaped balancer coupled to an upper end of the drum, and a container detachably coupled to the balancer to contain laundry. The container includes a container body opened at a top thereof, and containing the laundry therein, and a plurality of threads protruding from an outer surface of the container body, extending long in a vertical direction, and arranged in a circumferential direction. Each of the threads is formed such that heights from valleys to roofs are gradually increased in a direction from bottom to top. The balancer includes engagement grooves formed on a ring-shaped inner circumference thereof to engage with the plurality of threads.

14 Claims, 19 Drawing Sheets

(51) Int. Cl.
*D06F 31/00* (2006.01)
*D06F 37/24* (2006.01)

(56) References Cited

U.S. PATENT DOCUMENTS

2018/0094375 A1* 4/2018 Ramasco ..... D06F 37/16
2018/0363189 A1* 12/2018 Wei ..... D06F 37/304

FOREIGN PATENT DOCUMENTS

KR 1020150077059 7/2015
KR 1020150088882 8/2015
KR 1020160127681 11/2016
WO WO2017217810 12/2017

OTHER PUBLICATIONS

Office Action in Korean Appln. No. 10-2018-0036530, dated Apr. 18, 2022, 9 pages (with English translation).

* cited by examiner

WASHING MACHINE

CROSS-REFERENCE TO RELATED APPLICATIONS

This application is a National Stage application under 35 U.S.C. § 371 of International Application No. PCT/KR2019/000575, filed on Jan. 15, 2019, which claims the benefit of Korean Application No. 10-2018-0036530, filed on Mar. 29, 2018, and Korean Application No. 10-2018-0005236, filed on Jan. 15, 2018. The disclosures of the prior applications are incorporated by reference in their entirety.

TECHNICAL FIELD

The present disclosure relates to a washing machine and, more particularly, to a washing machine having two washing tubs.

BACKGROUND ART

A washing machine is a device that treats laundry through various operations including a washing operation, a spin-drying operation and/or a drying operation. The washing machine is a device that removes contaminants from laundry (hereinafter referred to as "cloth") using water and detergent.

Recently, a washing machine having two washing tubs comes into the market. Such a washing machine is provided with a large-capacity washing tub and a small-capacity washing tub, which are separated from each other. Since the washing tubs may be used at the same time or at different times depending on a user's needs, it is convenient to use. Furthermore, since only the small-capacity washing tub may be used when it is required to wash a small amount of laundry, it is very economical.

However, the conventional washing machine is problematic in that the two washing tubs are completely spatially separated from each other, so that the overall size of a product may be inevitably increased, and two drivers for driving the washing tubs, two water supply mechanisms for supplying water, and two drain mechanisms for draining water are required, so that the cost of products may also be increased.

Korean Patent Laid-Open Publication No. 10-2015-0089344 has disclosed a washing machine in which an auxiliary washing tub is coupled to an upper end of a rotary tub. Laundry may be separately accommodated in the rotary tub and the auxiliary washing tub, and separately washed in a state where water in the rotary tub is not mixed with water in the auxiliary washing tub.

As a coupling means of the rotary tub and the auxiliary washing tub, at least one protrusion is provided on the auxiliary washing tub, and a receiving groove is provided in a balancer that is provided on an upper end of the rotary tub to receive the protrusion.

However, such a washing machine is problematic in that the protrusion should be precisely aligned with the receiving groove to be fitted therein, when the auxiliary washing tub is installed. Therefore, since a user should make an attempt to fit the protrusion into the receiving groove while changing the posture of the auxiliary washing tub with the user holding the auxiliary washing tub, it is complicated to perform this process.

DISCLOSURE

Technical Problem

First, the present disclosure is to provide a washing machine configured such that a second washing tub is detachably installed in a first washing tub permanently installed in a cabinet, a toothed surface is formed on the second washing tub, and an engagement groove is formed in the first washing tub to engage with the toothed surface, so that the engagement of the toothed surface and the engagement groove is firmly maintained, thus preventing the second washing tub from running idle and enabling the second washing tub to rotate integrally with the first washing tub.

Second, the present disclosure is to provide a washing machine configured to prevent the toothed surface from easily slipping along the longitudinal direction of the engagement groove, even if the toothed surface is worn out.

Third, the present disclosure is to provide a washing machine configured to prevent the vertical motion of the second washing tub from occurring while the first washing tub is rotated integrally with the second washing tub.

Fourth, the present disclosure is to provide a washing machine configured such that multiple rows of threads are formed on a container of a second washing tub, and engagement grooves are formed in a balancer of a first washing tub to engage with the multiple rows of threads, thus allowing the container arranged in any posture to be easily coupled to the balancer, and preventing an undercut from being generated due to the multiple rows of threads even if the container is made through injection molding.

The present disclosure is not limited to the above-described objects, and other objects that are not mentioned will be clearly understood by those skilled in the art from the following description.

Technical Solution

A washing machine according to an embodiment of the present disclosure includes a drum rotated about a vertical axis, and opened at a top thereof; a ring-shaped balancer coupled to an upper end of the drum; and a container detachably coupled to the balancer to contain laundry, wherein the container includes a container body opened at a top thereof, and containing the laundry therein; and a plurality of threads protruding from an outer surface of the container body, extending long in a vertical direction, and arranged in a circumferential direction, each of the threads is formed such that heights from valleys to roofs are gradually increased in a direction from bottom to top, and the balancer includes engagement grooves formed on a ring-shaped inner circumference thereof to engage with the plurality of threads.

Each of the threads may extend helically. A helix may include an inflection point.

The plurality of threads may include a first thread, a second thread, and a third thread that are sequentially arranged in the circumferential direction. A distance from a roof of the second thread to a valley formed when the second thread meets the first thread may be different from a distance from the roof of the second thread to a valley formed when the second thread meets the third thread.

The outer surface of the container body may be inclined to gradually approach the vertical axis in a direction from top to bottom.

The container may further include an annular rim portion that is formed on the upper end of the container body. The washing machine may further include a washing-tub cover that is coupled to the rim portion and has an opening for putting the laundry into the container.

A washing machine according to an embodiment of the present disclosure includes a first washing tub rotated about a vertical axis; and a second washing tub detachably coupled to the first washing tub, and rotated integrally the first washing tub, wherein the second washing tub includes a plurality of threads formed in a circumferential direction, and wherein the first washing tub includes a plurality of engagement grooves formed in a circumferential direction to engage with the plurality of threads, respectively, wherein each of the threads may be formed such that heights from valleys to roofs are gradually increased in a direction from lower ends to upper ends of the threads.

According to an embodiment, a plurality of threads may be formed on an outer circumference of a container installed in a balancer, and engagement grooves may be formed in the balancer to engage with the plurality of threads.

The container includes a container body opened at a top thereof and containing the laundry therein, a plurality of threads protruding from an outer surface of the container body The plurality of threads may include lower surfaces that protrude from the outer surface to form a plurality of rows, When a pair of adjacent threads among the threads is defined as a first thread and a second thread located under the first thread, the second thread may be formed by upwards extruding the lower surface of the second thread and connecting the lower surface to the lower surface of the first thread.

The lower surface of each thread may be inclined to be gradually distant from the vertical axis in a direction from the bottom to the top.

A height of each of the threads protruding from the outer surface may be gradually reduced in a direction from the upper end to a lower end of the thread.

The outer surface may be inclined to gradually approach the vertical axis in a direction from top to bottom. When viewing the container body in a horizontal direction to observe heights of the first and second threads protruding from the outer surface, a height of the second thread protruding from the outer surface may be lower than a height of the first thread protruding from the outer surface The second thread may be inclined such that an outer circumference connecting the lower surface of the first thread and the lower surface of the second thread gradually approaches the vertical axis in the direction from top to bottom.

Details of other embodiments are included in the detailed description and the accompanying drawings.

Advantageous Effects

First, a washing machine of the present disclosure is advantageous in that a binding force between a first washing tub and a second washing tub is always maintained, so that the first washing tub and the second washing tub may be rotated stably and integrally.

Second, a washing machine of the present disclosure is advantageous in that engagement of a first washing tub and a second washing tub is not loosened, even if an engaged portion of the first and second washing tubs is worn out.

Third, a washing machine of the present disclosure is advantageous in that it prevents the vertical motion of a second washing tub from occurring, thus preventing the second washing tub from colliding with a door. Therefore, it is possible to prevent devices from being broken or damaged and to prevent accidents from occurring.

Fourth, a washing machine of the present disclosure is advantageous in that multiple rows of threads can be formed on an outer surface of a container body without undercuts, even if molds that are vertically opened or closed are used.

The present disclosure is not limited to the above-described effects, and other effects that are not mentioned will be clearly understood by those skilled in the art from the attached claims.

MODE FOR DISCLOSURE

Figure 1:
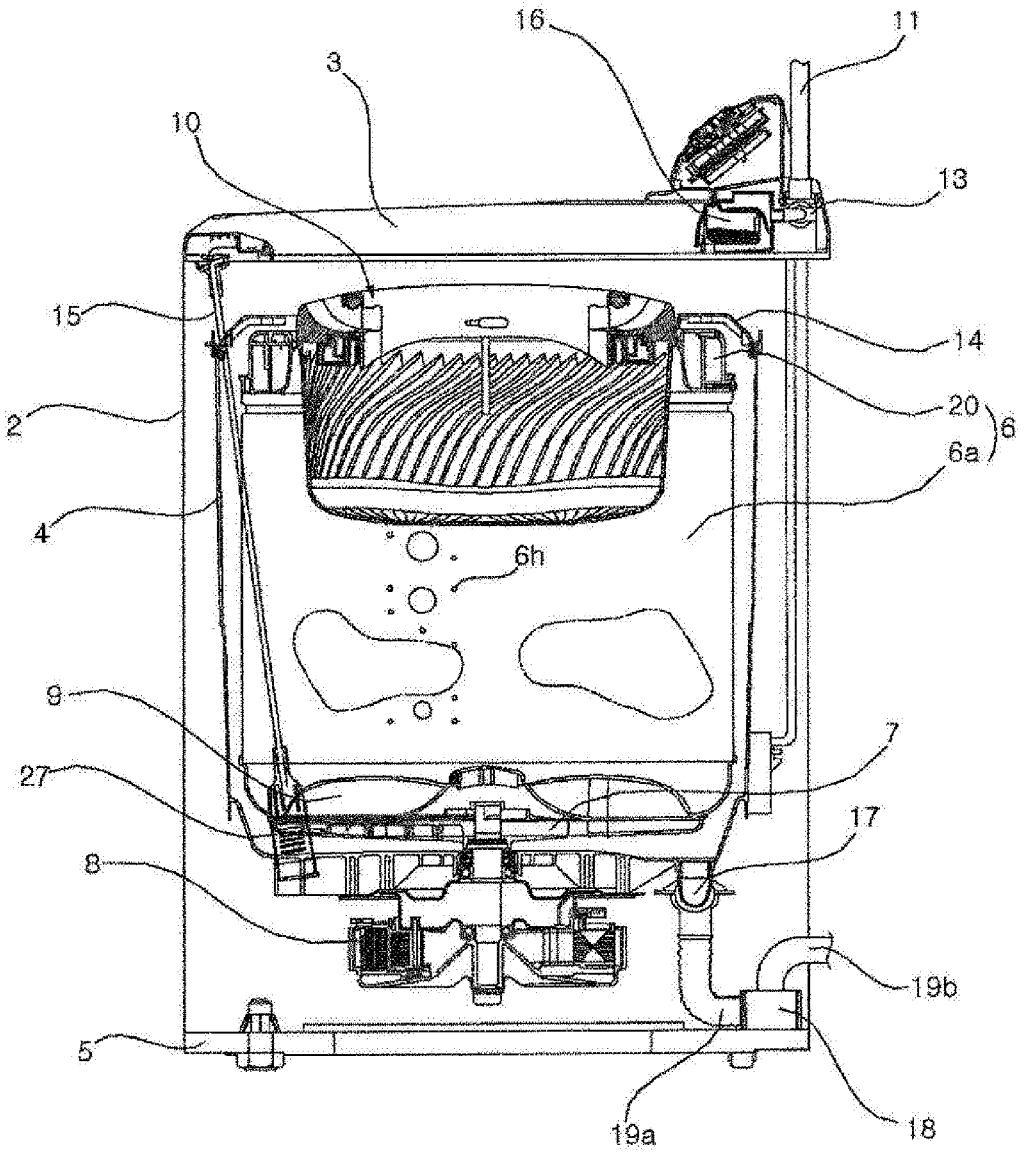
FIG. 1 is a side sectional view of a washing machine in accordance with an embodiment of the present disclosure.

The above and other objectives, features, and other advantages of the present invention will be more clearly understood from the following detailed description when taken in conjoint with the accompanying drawings. However, the present disclosure may be embodied in other aspects without being limited to the embodiments disclosed below. The embodiments are provided to make the present disclosure complete and to sufficiently convey the scope of the present disclosure to those skilled in the art without departing from the scope of the claims. In the present specification, it should be noted that the same reference numerals are used to denote the same components throughout different drawings.

Figure 2:
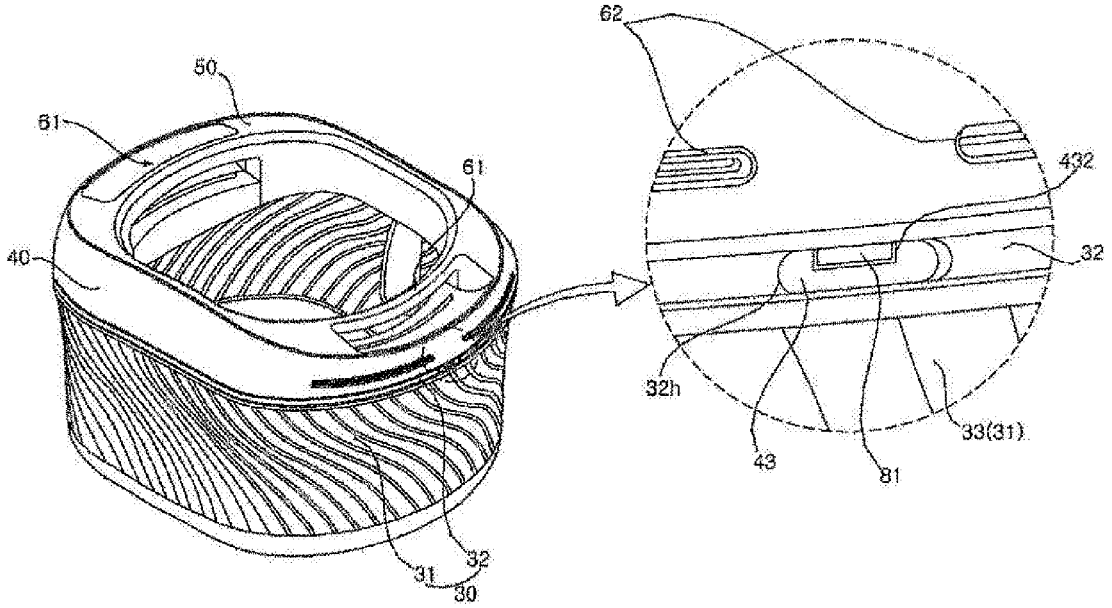
FIG. 2 is a perspective view of a second washing tub.

FIG. 1 is a side sectional view of a washing machine in accordance with an embodiment of the present disclosure. FIG. 2 is a perspective view of a second washing tub. FIG.

Figure 4:
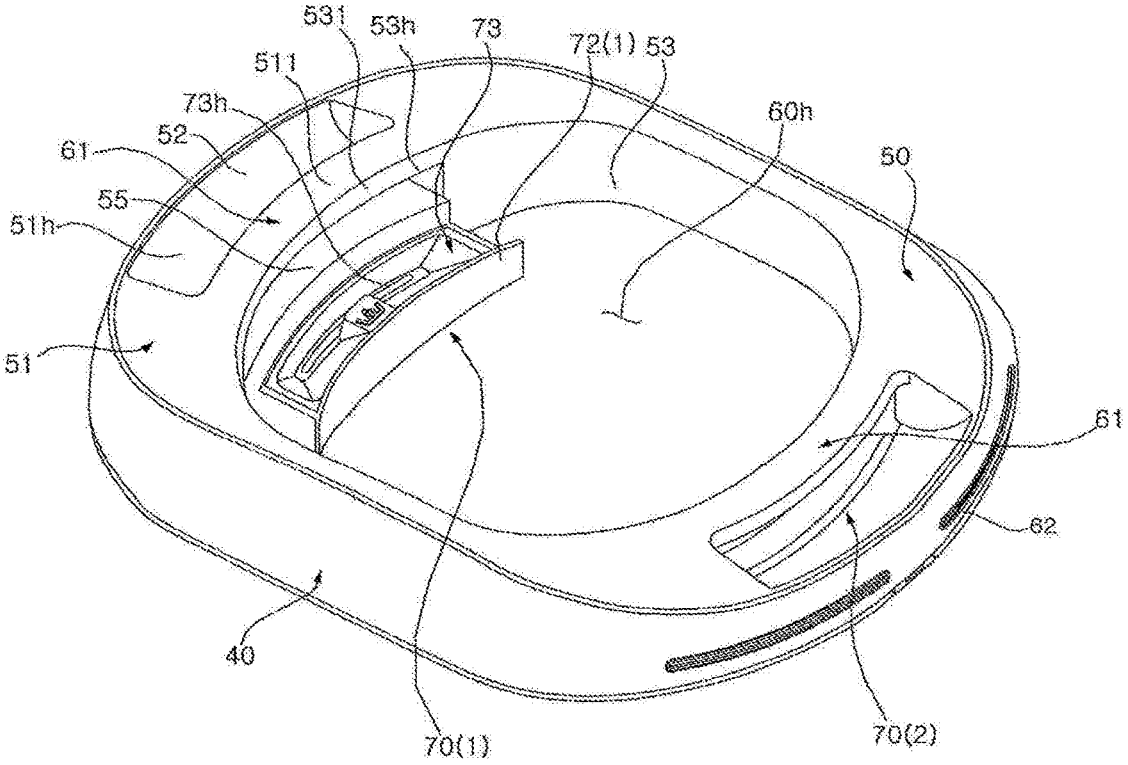
FIG. 4 is a perspective view illustrating a washing-tub cover.
Figure 5:
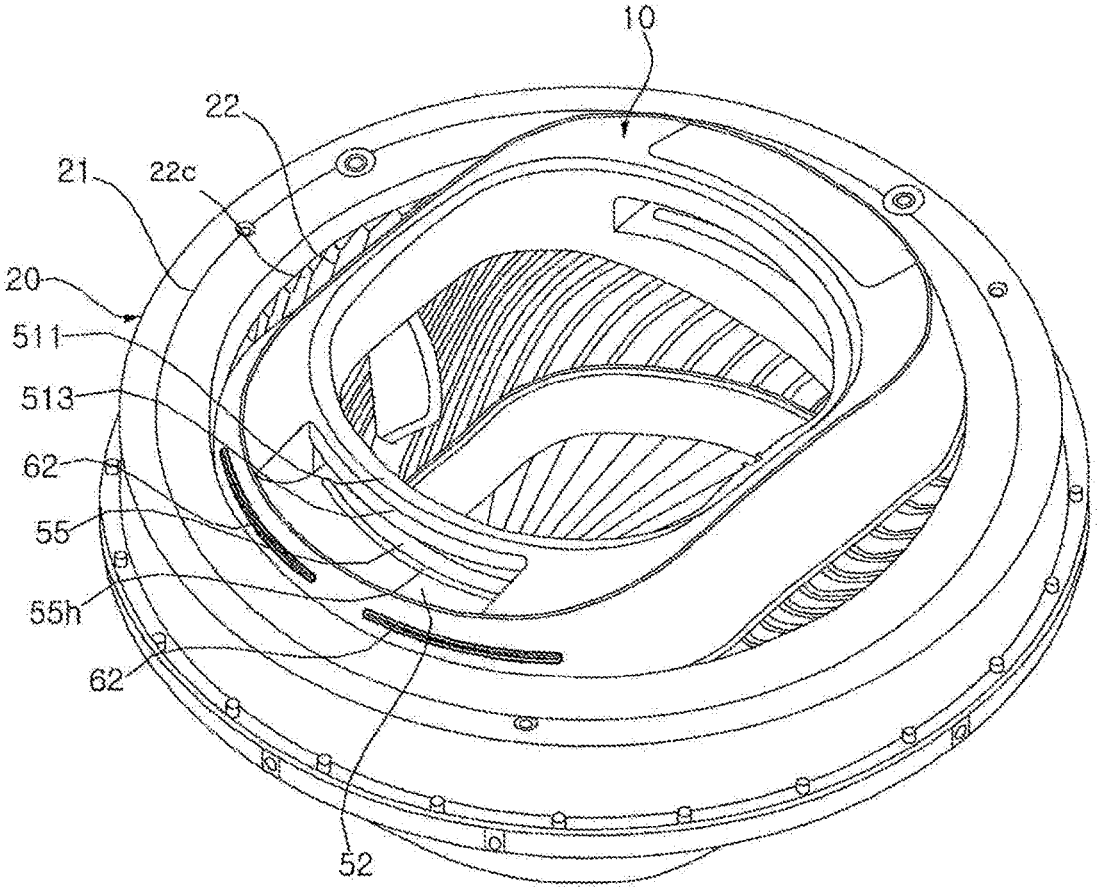
FIG. 5 is a perspective view illustrating a state in which the second washing tub is installed in a balancer.
Figure 6:
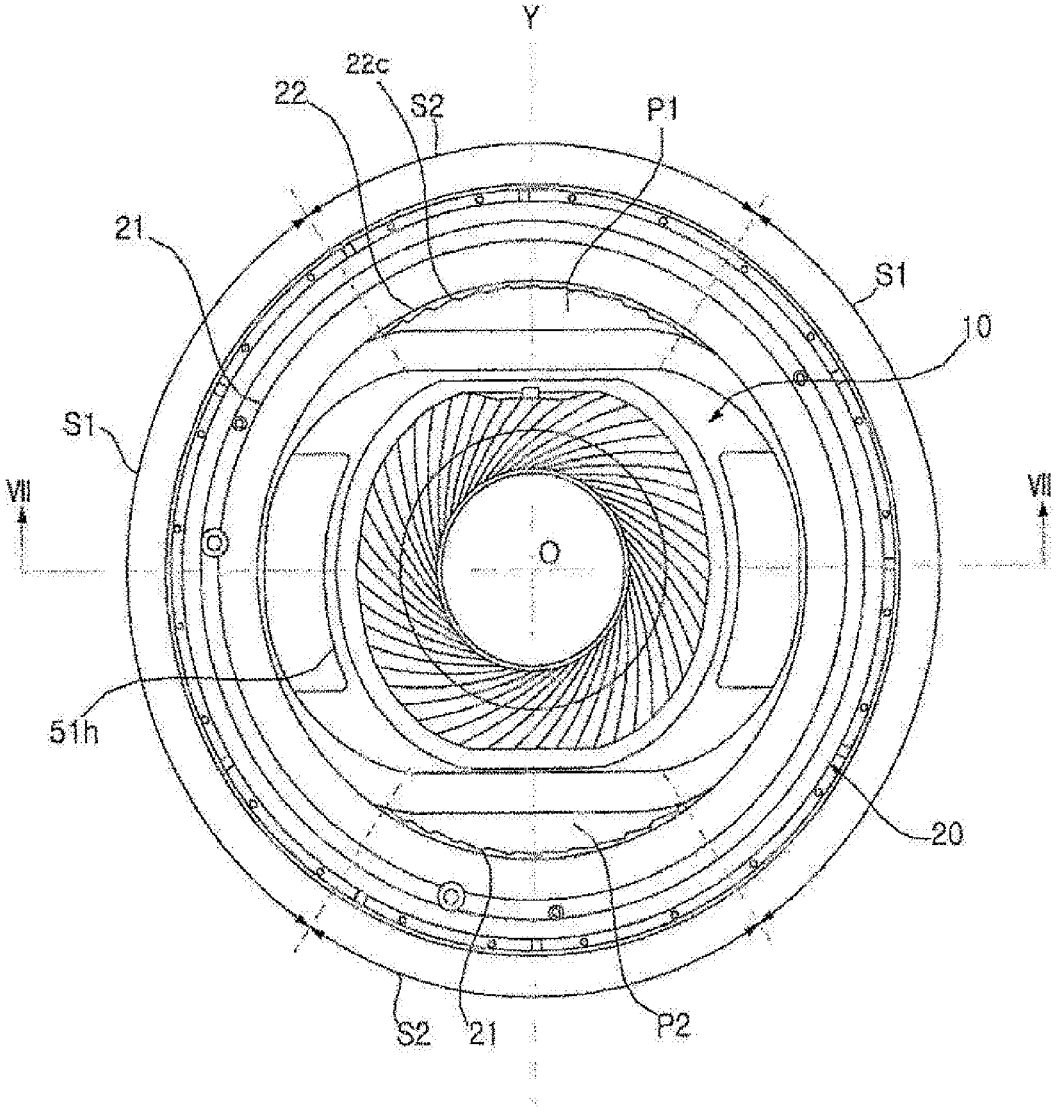
FIG. 6 is a top view of an assembly illustrated in FIG. 5.
Figure 7:
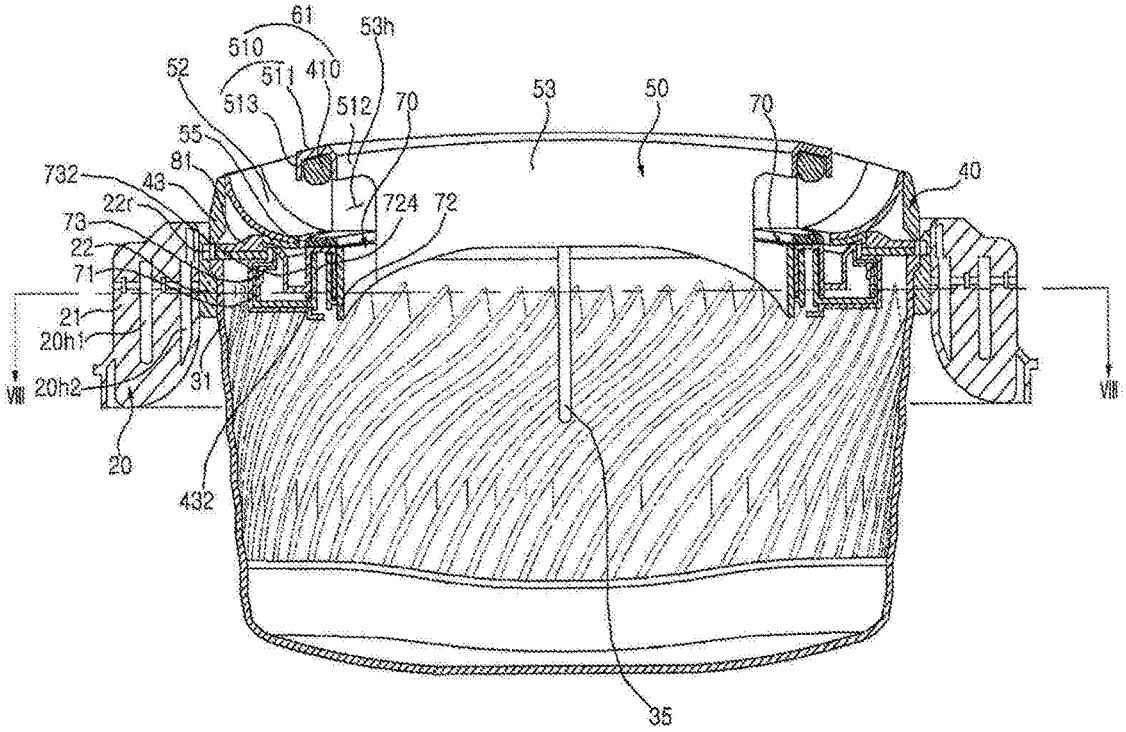
FIG. 7 is a sectional view taken along line VII-VII of FIG. 6, in which a locking member is in a first position.
Figure 8:
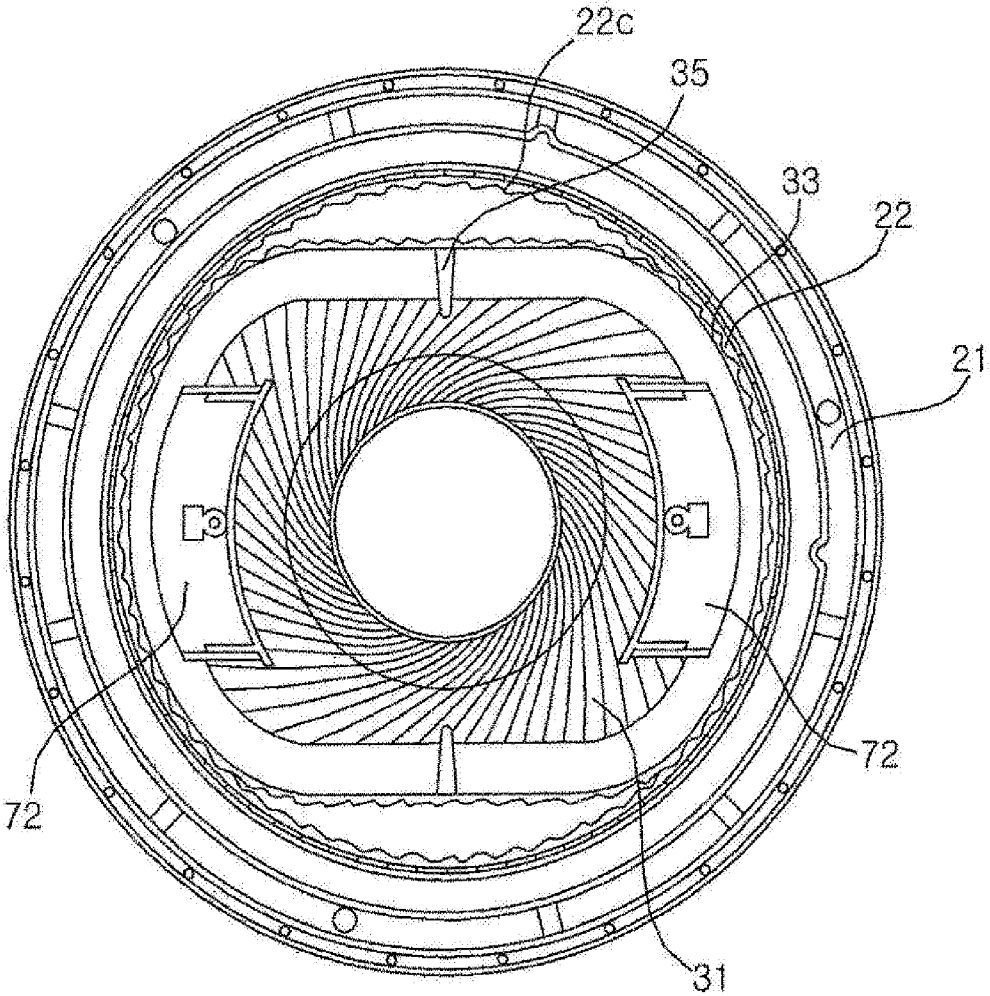
FIG. 8 is a sectional view taken along line VIII-VIII of FIG. 7.
Figure 9:
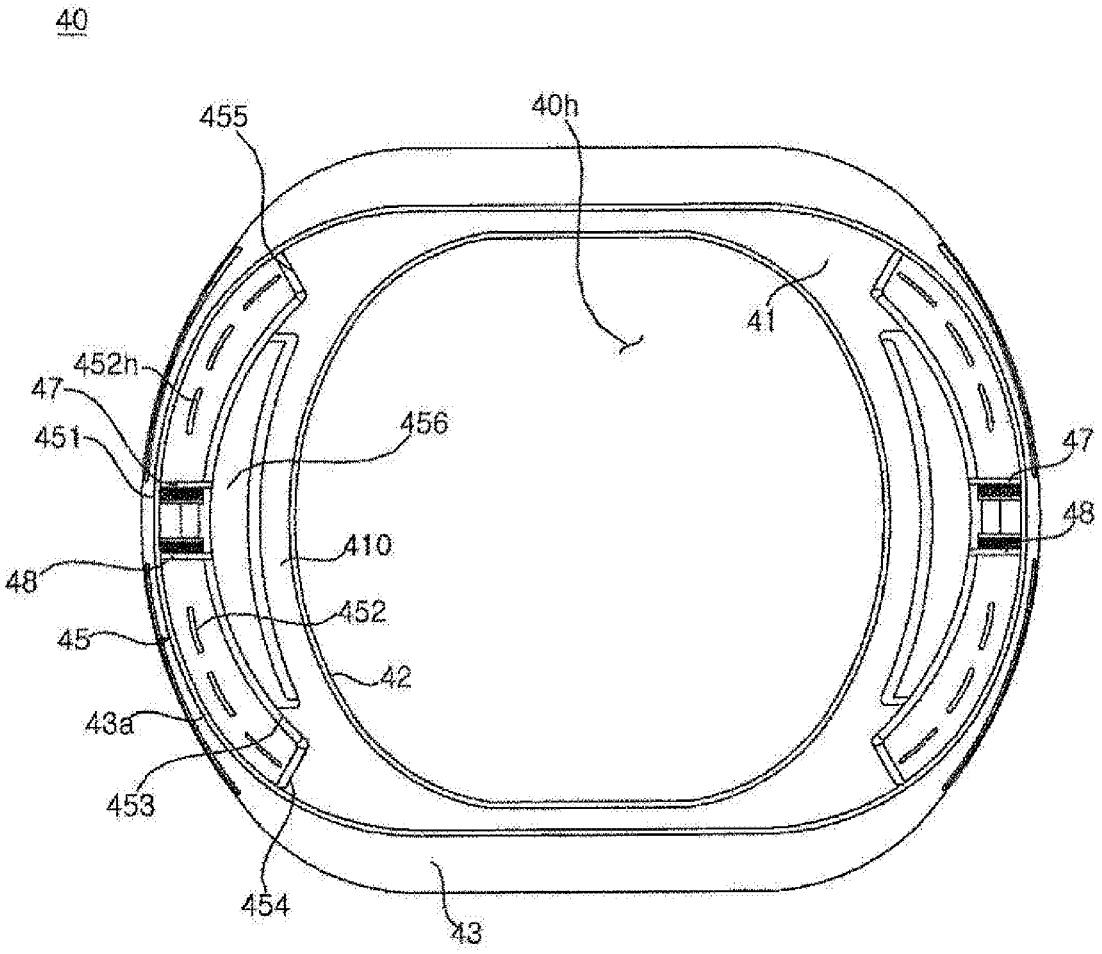
FIG. 9 is a top view of an upper cover.
Figure 10:
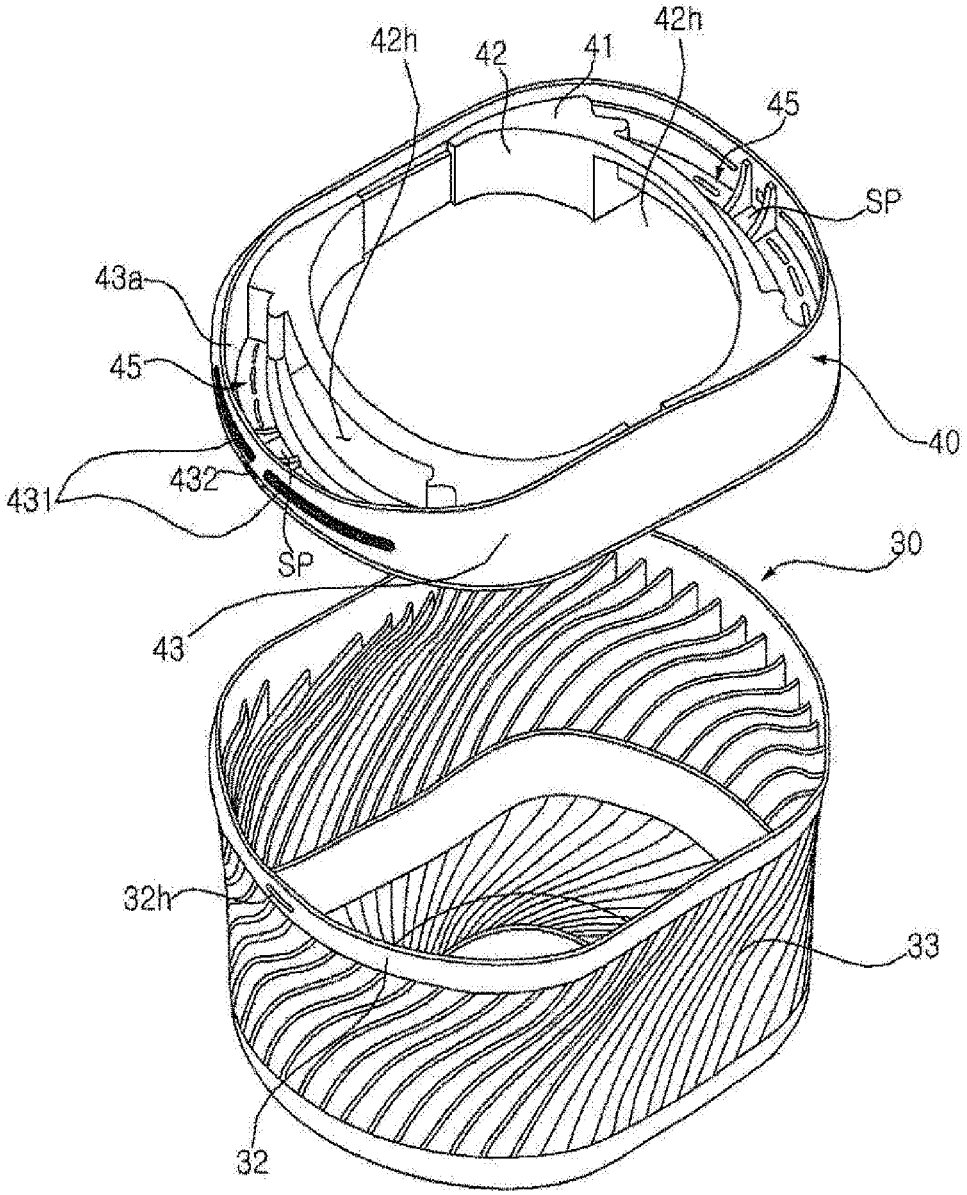
FIG. 10 illustrates a state in which the upper cover and a container are separated from each other.
Figure 11:
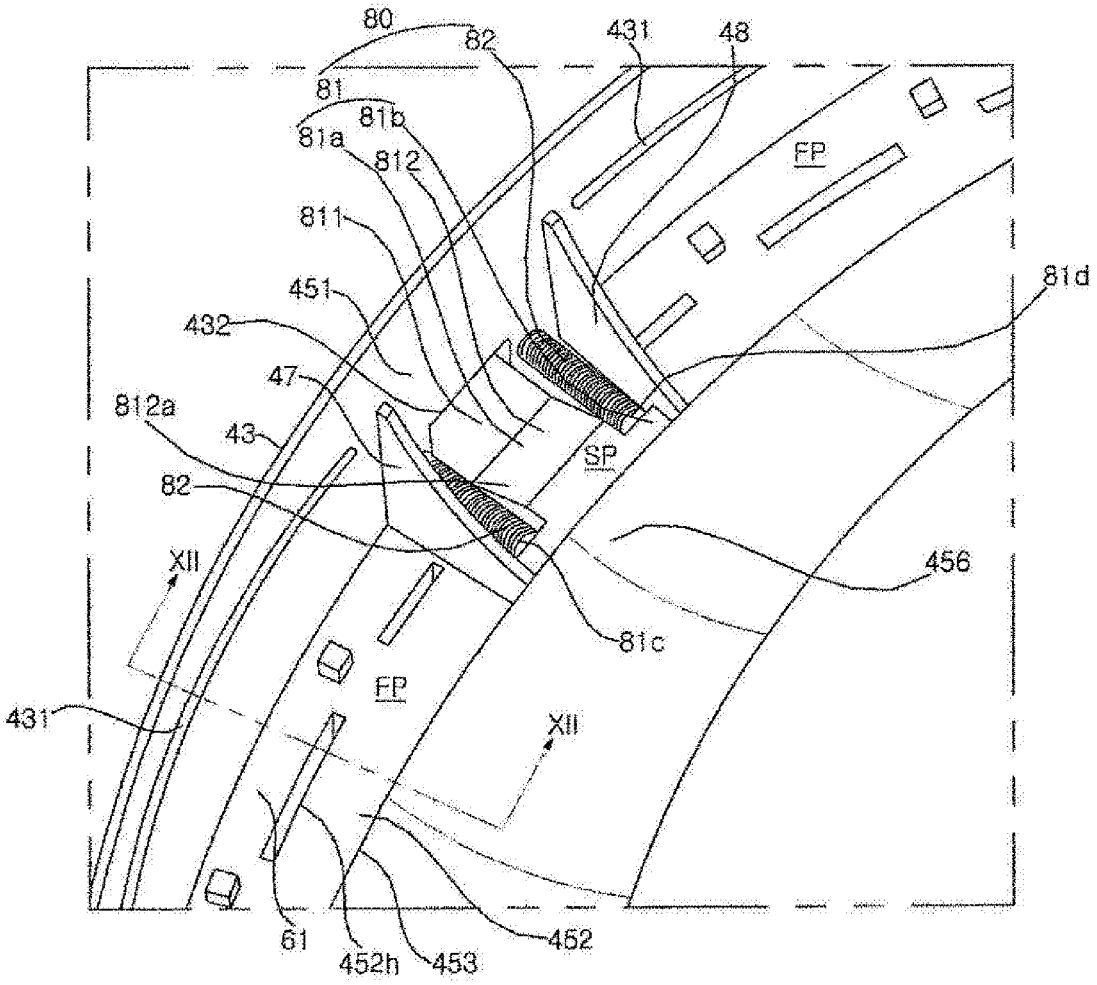
FIG. 11 illustrates a state in which a locker is installed on the upper cover, particularly, a state in which the locker is disposed between a pair of partition walls.
Figure 12:
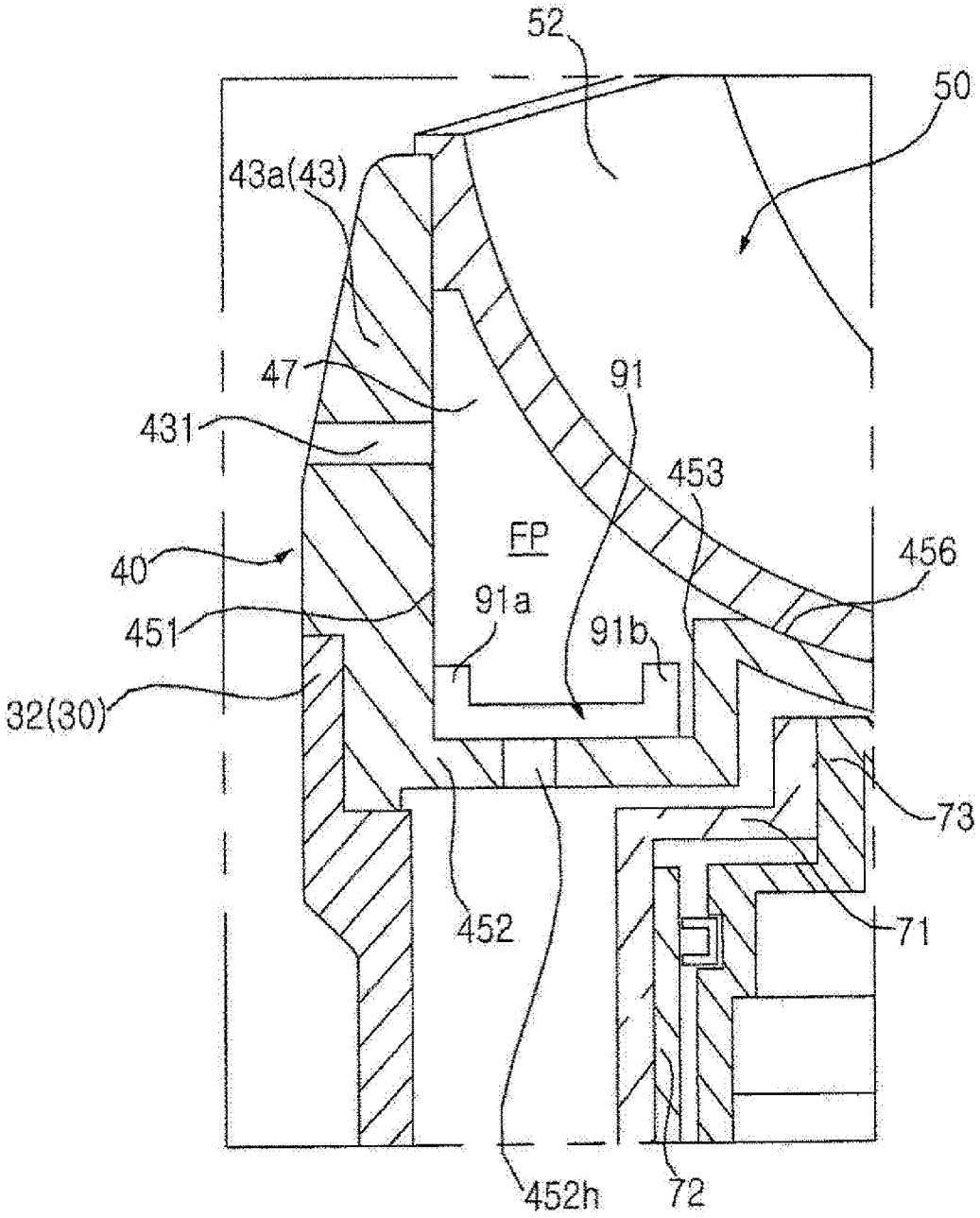
FIG. 12 is a sectional view taken along line XII-XII of FIG. 11.
Figure 13:
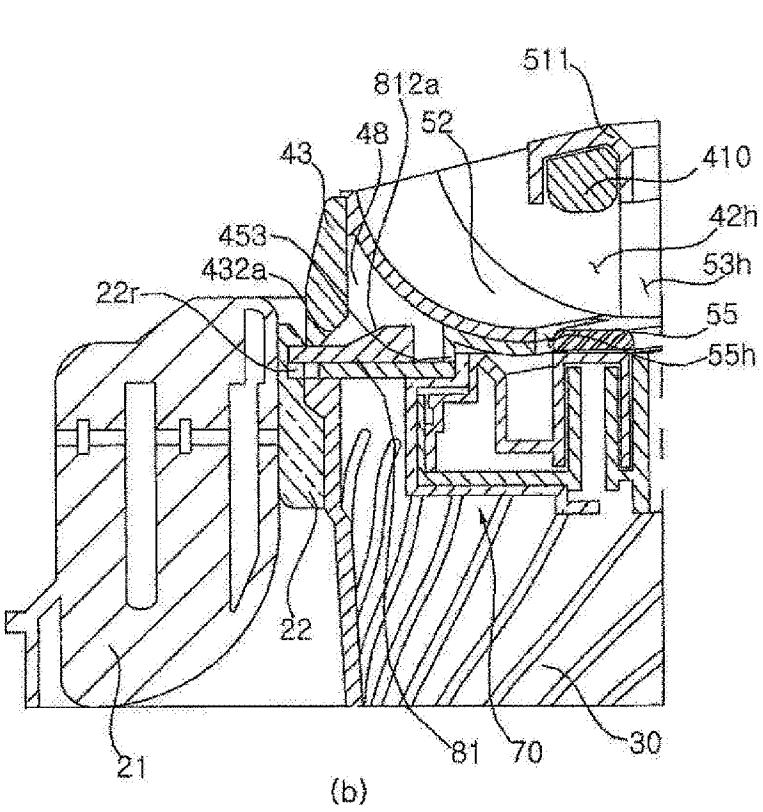
FIG. 13 is an enlarged view of a portion of FIG. 7, in which FIG. 13(*a*) shows a state in which a locking member is in a first position, and FIG. 13(*b*) shows a state in which the locking member is in a second position.
Figure 13:
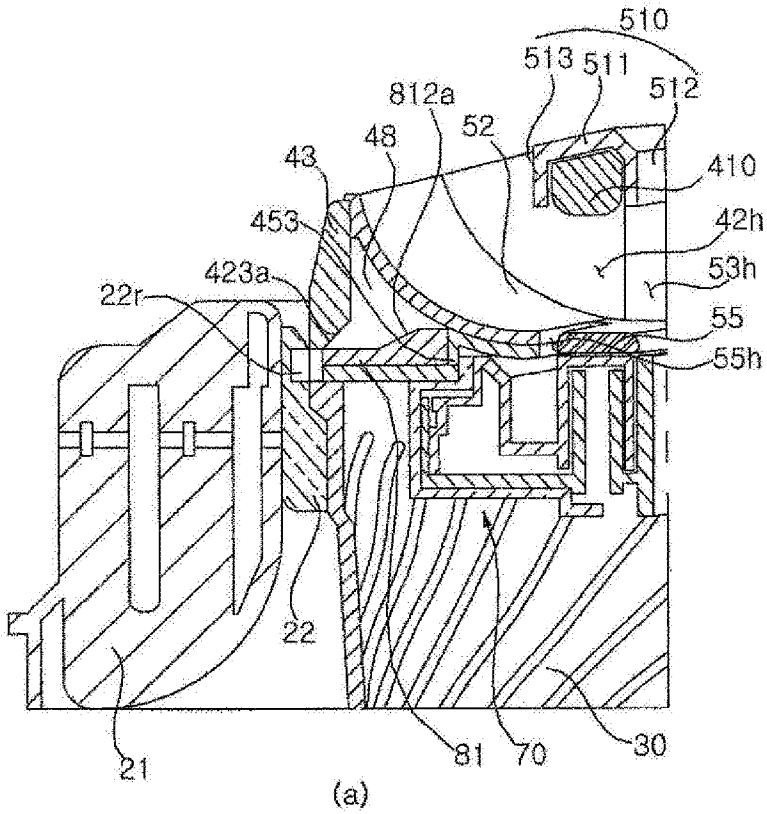
Figure 14:
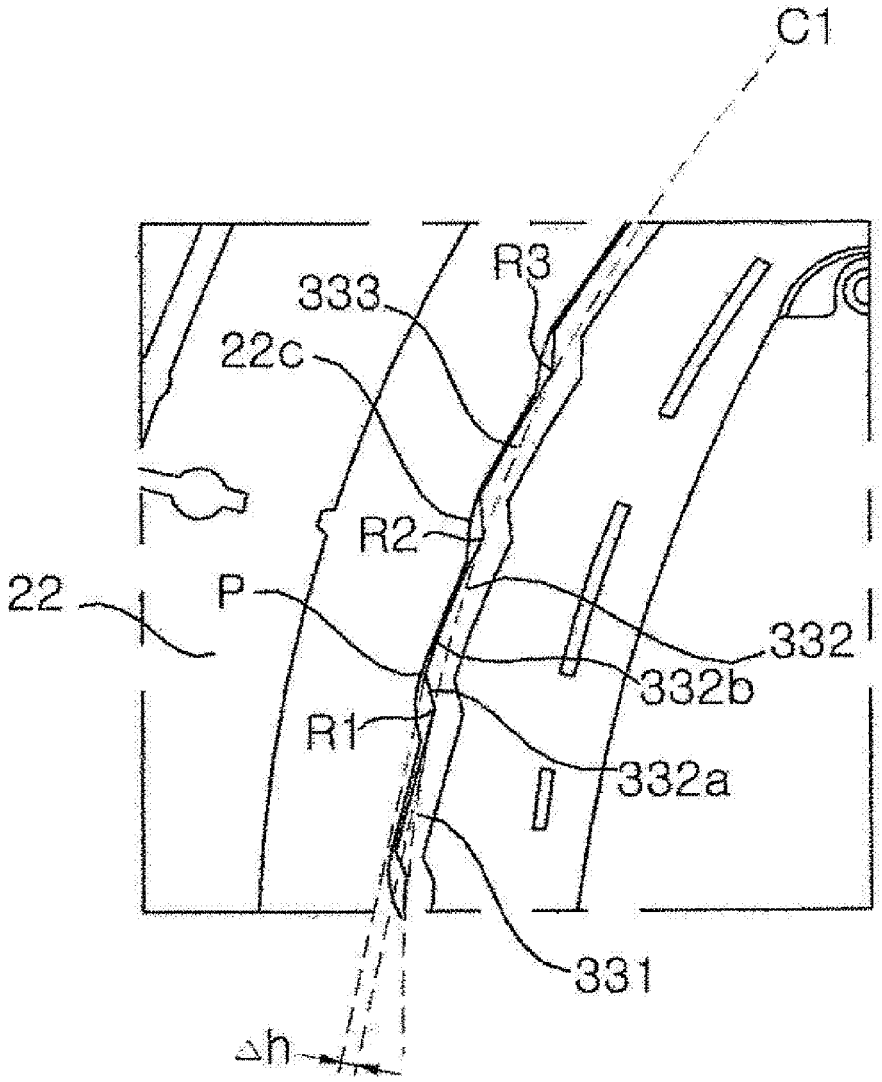
FIG. 14 is an enlarged view of portion A in FIG. 8.
Figure 15:
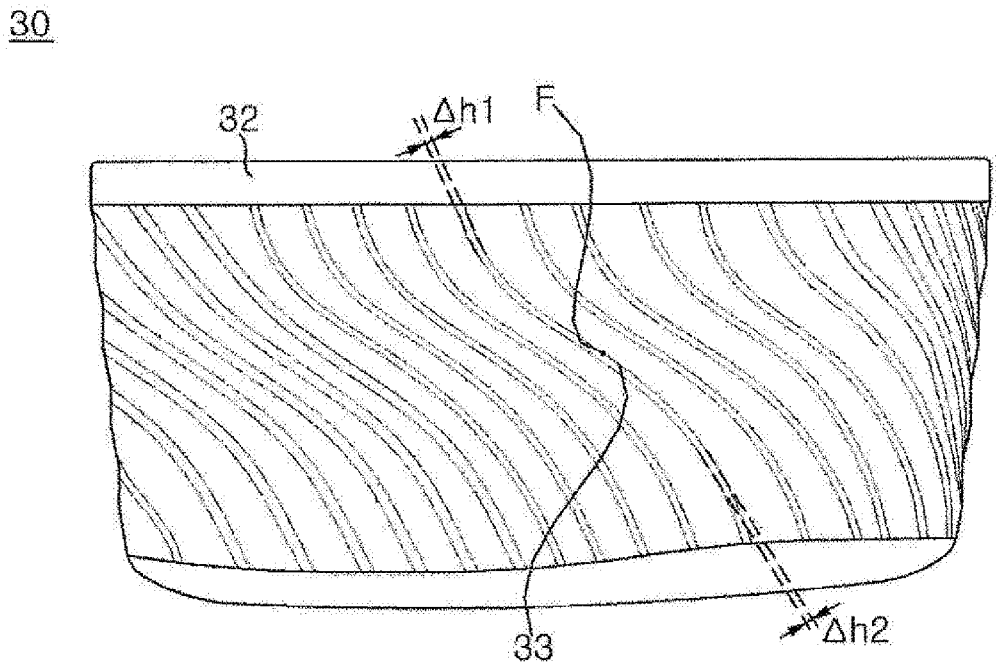
FIGS. 15 and 16 are side views of a container.

3 is an exploded perspective view of the second washing tub. FIG. 4 is a perspective view illustrating a washing-tub cover. FIG. 5 is a perspective view illustrating a state in which the second washing tub is installed in a balancer. FIG. 6 is a top view of an assembly illustrated in FIG. 5. FIG. 7 is a sectional view taken along line VII-VII of FIG. 6, in which a locking member is in a first position. FIG. 8 is a sectional view taken along line VIII-VIII of FIG. 7. FIG. 9 is a top view of an upper cover. FIG. 10 illustrates a state in which the upper cover and a container are separated from each other. FIG. 11 illustrates a state in which a locker is installed on the upper cover, particularly, a state in which the locker is disposed between a pair of partition walls. FIG. 12 is a sectional view taken along line XII-XII of FIG. 11. FIG. 13 is an enlarged view of a portion of FIG. 7, in which FIG. 13(*a*) shows a state in which a locking member is in a first position, and FIG. 13(*b*) shows a state in which the locking member is in a second position. FIG. 14 is an enlarged view of portion A in FIG. 8. FIG. 15 is a side view of a container. Hereinafter, a washing machine in accordance with an embodiment of the present disclosure will be described with reference to FIGS. 1 to 15.

Referring to FIG. 1, a cabinet 2 defines an appearance of a washing machine, and forms a space in which a water storage tub 4 is accommodated. The cabinet 2 is supported by a flat cabinet base 5, includes a front surface, a left surface, a right surface, and a rear surface, and is opened at a top thereof.

A top cover 3 may be coupled to the open top of the cabinet 2. An opening may be formed in the top cover 3 to put or take laundry (or "cloth") into or out from the cabinet. A door (not shown) may be rotatably coupled to the top cover 3 to open or close the opening.

The water storage tub 4 contains water therein, and may be suspended in the cabinet 2 by a support rod 15. The support rod 15 may be provided on each of four corners of the cabinet 2. A first end of the support rod 15 is pivotably connected to the top cover 3, and a second end thereof is connected to the water storage tub 4 by a suspension 27 that absorbs vibration.

The water storage tub 4 may be opened at a top thereof, and a water-storage-tub cover 14 may be provided on the open top. The water-storage-tub cover 14 has a ring shape in which an approximately circular opening is formed in a central portion thereof, so that the laundry is put into the water storage tub through the opening.

In the water storage tub 4, a first washing tub 6 may be disposed to receive the laundry and rotate about a vertical axis. The vertical axis is substantially perpendicular to the ground. Although the vertical axis may be precisely aligned with a line perpendicular to the ground, it may form a predetermined angle with the vertical line without being limited thereto. A plurality of holes 6*h* is formed in the first washing tub 6 to allow water to pass therethrough, and water flows through the holes 6*h* between the first washing tub 6 and the water storage tub 4.

The first washing tub 6 may include a drum 6*a* that is opened at a top thereof, with the holes 6*h* being formed therein, and a ring-shaped balancer 20 that is coupled to the top of the drum 6*a*. A bottom of the drum 6*a* may be connected to a rotating shaft of a driver 8 by a hub 7.

A pulsator 9 may be rotatably provided in a lower portion of the first washing tub 6. The pulsator 9 may include a plurality of radial blades that protrude upwards. When the pulsator 9 is rotated, a water stream is created by the blades.

The balancer 20 compensates for eccentricity caused by the rotation of the drum 6*a*. The balancer 20 is coupled to an upper end of the drum 6*a*. Referring to FIGS. 5 to 7, the balancer 20 may include a balancer body 21 that forms ring-shaped cavities 20*h*1 and 20*h*2. Fluid (e.g. salt water) or a plurality of weights (e.g. metal spheres) may be inserted into the cavities 20*h*1 and 20*h*2. A plurality of annular cavities 20*h*1 and 20*h*2 may be formed to be concentric or have different diameters.

If the drum 6*a* is biased to one side during its rotation, the fluid or the weights are moved in a direction opposite to the biased direction of the drum 6*a* to correct eccentricity. Since various types of ring-shaped balancers 20 that are applied to the washing machine are already known to those skilled in the art, a detailed description thereof will be omitted.

The second washing tub 10*a* may be inserted into a space (or approximately circular opening) defined by the ring-shaped balancer 20, and may be supported by the balancer 20 in the inserted state. The second washing tub 10 includes a container 30 that contains laundry, and a washing-tub cover 60 that covers the container 30. The container 30 contains laundry and water and is opened at a top thereof. At least a portion of the opened top is covered by the washing-tub cover 60. The container 30 may be made of a transparent material so that the laundry contained therein may be seen from an outside.

A ring-shaped support 22 may be formed on an inner-diameter portion of the balancer body 21 (a portion forming an inner circle among two circles forming the ring shape when viewed from above) to support the container 30. A plurality of engagement grooves 22*c* (see FIG. 8) extending in a vertical direction is arranged on the support 22 along a circumferential direction. Each engagement groove 22*c* may have a helical shape.

Referring to FIGS. 14 and 15, a plurality of threads 33 is circumferentially formed on the second washing tub 10. The threads 33 are projections formed on the outer surface of the container 30, and engage with engagement grooves 22*c* formed on a support 22. To be more specific, the plurality of threads 33 is circumferentially arranged to protrude from an outer surface of a container body 31 (see FIG. 7) and extend vertically.

The engagement groove 22*c* extends vertically to have a shape corresponding to that of the thread 33. The thread 33 may have a helical shape. The helix may be formed to have an inflection point F. The engagement groove 22*c* also may have a helical shape corresponding to that of the thread 33.

The threads 33 form a kind of helical gear (or helical tooth) to engage with the engagement grooves 22*c* formed in a seat 33 of the balancer 20. Due to such a structure, when the first washing tub 6 is rotated, the second washing tub 10*a* may be rotated integrally with the first washing tub 6 without running idle. Furthermore, since the balancer 20 and the container 30 are coupled in a screw-type fastening method, the coupling of the second washing tub 10 and the first washing tub 6 is reliably maintained. Particularly, the second washing tub 10 may be fixed without moving downwards by binding force (e.g. frictional force acting between surfaces that engage with each other) generated by coupling between the threads 33 and the engagement grooves 22*c*.

A height Δh (depth of thread) from a valley (e.g. R2) to a roof (e.g. P) of each thread 33 or a depth from the roof to the valley is gradually increased in a direction from bottom to top. That is, the thread depth Δh of each thread 33 is gradually increased in the direction from bottom to top. In FIG. 15, Δh1 denotes a thread depth at the upper end of the thread 33, and Δh2 denotes a thread depth at the lower end of the thread 33. Here, Δh1>Δh2.

Meanwhile, such a structure where the thread depth Δh is gradually increased in the direction from bottom to top is preferably applied to an entire area from the lower end to the upper end of the thread 33. However, this is not essential. For example, the thread depth Δh may be gradually increased in the direction from bottom to top only in a portion where the thread 33 engages with the engagement groove 22*c*.

Meanwhile, the plurality of threads 33 may include a first thread 331, a second thread 332, and a third thread 333 that are sequentially arranged in a circumferential direction. Here, assuming that a valley formed when the first thread 331 meets the second thread 332 is designated as a first valley R1, and a valley formed when the second thread 332 meets the third thread 333 is designated as a second valley R2, a first distance L1 from the roof P to the first valley R2 of the second thread 332 and a second distance L2 from the roof P to the second valley R3 of the second thread 332 may be different from each other. As illustrated in FIG. 14, if the first distance L1 is longer than the second distance L2, an inclination of the first toothed surface 332*a* extending from the roof P to the first valley R1 of the second thread 332 may be greater than an inclination of the second toothed surface 332*b* extending from the roof P to the second valley R2 of the second thread 332. Here, the inclination is an angle between each toothed surface 332*a* or 332*b* and a tangent plane of a circumference C1. The inclination of the first toothed surface 332*a* is defined on the basis of the tangent plane on the first valley R1, and the inclination of the second toothed surface 332*b* is defined on the basis of the tangent plane on the second valley R3.

Meanwhile, the outer surface of the container body 31 may be inclined to gradually approach a vertical axis O in a direction from top to bottom. This allows a molded product from being easily removed from the mold while the container body 31 is injection-molded, and allows the lower end of each thread 33 to be spaced apart from the inner surface (or engagement surface) of the engagement groove 22*c* while the second washing tub 10 is mounted on the balancer 20, thus passing through an opening formed in a central portion of the balancer 20. In the state where the second washing tub 10 is installed, at least some threads 33 are located under the support 22 without engaging with the engagement groove 22*c*. The second washing tub 10 contains laundry, and is removably provided in the first washing tub 6. That is, the second washing tub 10 is detachably coupled to the first washing tub 6. If the first washing tub 6 is rotated in a state in which the second washing tub 10 is installed, the second washing tub 10 is also rotated integrally with the first washing tub 6.

A user may put first laundry into the first washing tub 6 in a state where the second washing tub 10 is not installed, or may install the second washing tub 10 and then put second laundry into the second washing tub 10.

Referring to FIG. 1, the driver 8 may be disposed in the cabinet 2 to provide power for rotating the first washing tub 6 and the pulsator 9. The driver 8 may be disposed under the water storage tub 4, and be suspended in the cabinet 2 while being coupled to a bottom of the water storage tub 4.

The rotating shaft of the driver 8 may be always connected to the pulsator 9, and be connected or disconnected to or from the first washing tub 6 by the conversion of a clutch (not shown). Therefore, when the driver 8 is operated with its rotating shaft being connected to the first washing tub 6, the pulsator 9 and the first washing tub 6 are integrally rotated. When the rotating shaft is operated while being disconnected (or separated) from the first washing tub 6, the first washing tub 6 is stopped and only the pulsator 9 is rotated.

The driver 8 may include a washing motor capable of controlling speed. The washing motor may be an inverter direct drive motor. A controller (not shown) may include a Proportional-Integral controller (PI controller), a Proportional-Integral-Derivative controller (PID controller), etc. An output value (e.g. output current) of the washing motor is input into the controller. Based on the output value, the controller may control such that the rpm (or rotating speed) of the washing motor follows preset target rpm (or target rotating speed).

The controller may control the overall operation of the washing machine as well as the washing motor. It will be understood that each of components mentioned below is controlled by the control of the controller.

Meanwhile, the washing machine may include at least one water supply pipe 11 that guides water supplied from an external water source such as a faucet. At least one water supply pipe 11 may include a cold-water pipe (not shown) that receives cold water from the external water source, and a hot-water pipe (not shown) that receives hot water therefrom.

A water supply valve 13 may be provided to control the water supply pipe 11. If a plurality of water supply pipes 11 is provided, a plurality of water supply valves 13 is likewise provided, so that the water supply pipes 11 may be controlled, respectively, by the water supply valves 13. If at least one water supply valve 13 is opened under the control of the controller, water is supplied through the opened water supply valve 13 and the corresponding water supply pipe 11 to a main dispenser 16.

The main dispenser 16 supplies an additive acting on laundry through the water supply pipe 11 to the water storage tub 4, along with the supplied water. The additive supplied by the main dispenser 16 includes a washing detergent, a fabric softener, bleach, etc.

Meanwhile, the washing machine may further include a drain bellows 19*a* that discharges water from the water storage tub 4, and a drain valve 17 that controls the drain bellows 19*a*. The drain bellows 19*a* may be connected to a pump 18. When the drain valve 17 is opened, water is supplied through the drain bellows 19*a* to the pump 18. As such, when the pump 18 is operated, water introduced into the pump 18 is discharged through a drain pipe 19*b* to an outside of the washing machine.

A laundry feed opening 60*h* (see FIG. 4) is formed in a central portion of the washing-tub cover 60 to put laundry into the container 30. The washing-tub cover 60 may include a lower cover 40, and an upper cover 50 coupled to a top of the lower cover 40. The lower cover 40 may be coupled to the upper end of the container 30. The lower cover 40 and the container 30 may be made of synthetic resin, and be coupled to each other preferably by bonding, more preferably by thermal bonding. However, the present disclosure is not limited thereto.

The upper cover 50 and the lower cover 40 may be detachably coupled to each other. A first opening 40*h* is formed in the lower cover 40, while a second opening 50*h* is formed in the upper cover 50 to communicate with the first opening 40*h* and define the laundry feed opening 60*h*.

A space in which a locking member 81 (see FIG. 7), a check valve 91 (see FIG. 9), etc. that will be described below are disposed is provided between the upper cover 50 and the lower cover 40. When necessary, a user may separate the upper cover 50 from the lower cover 40, so that it is possible to maintain or repair the locker 80 or the check valve 91 and to clean a flow path.

A water supply port 51*h* may be formed in the washing-tub cover 60 to introduce water that is discharged from the main dispenser 16. A sub dispenser 70 is provided in the washing-tub cover 60 to contain the additive such as the detergent, the bleach or the fabric softener, and water supplied to the water supply port 51*h* is supplied to the container 30 along with the additive while passing through a sub dispenser 70. The additive is preferably liquid to be smoothly discharged through a siphon pipe 724 that will be described below.

Water may be supplied multiple times through the water supply port 51*h*. In this case, since all the additive is discharged through the siphon pipe 724 during a first water supply operation, water (or raw water) in which the additive is not dissolved is supplied through the sub dispenser 70 during a subsequent water supply operation.

Meanwhile, if the second washing tub 10 is rotated at sufficient speed, a water stream developed to an outside in a radial direction by the centrifugal force in the container 30 may move upwards along an inner surface of the container 30 (i.e. inner surface of a container body 31) to be introduced into the washing-tub cover 60 through the inlet 452*h* that will be described below. A flow path FP (see FIG. 12) is formed on the washing-tub cover 60 to guide the water stream introduced through the inlet port 452*h*.

The washing-tub cover 60 may include a nozzle 62 that discharges the water stream guided along the flow path FP to the outside of the washing-tub cover 60. The nozzle 62 may be fixedly inserted into the outlet 431 (see FIG. 12) formed in the lower cover 40. The nozzle 62 may be provided with a slit-shaped exit extending long in a horizontal direction.

The exit is opened towards a side lower than the water-storage-tub cover 14. The second washing tub 10 is rotated at high speeds, so that water discharged through the nozzle 62 may be guided along the bottom of the water-storage-tub cover 14.

As illustrated in FIG. 5, in a state where the second washing tub 10 is installed in the balancer 20, the nozzle 62 is located above the balancer 20 (i.e. exposed above the balancer 20), so that water sprayed through the nozzle 62 may reach the water storage tub 4 without interfering with the balancer 20.

Figure 3:
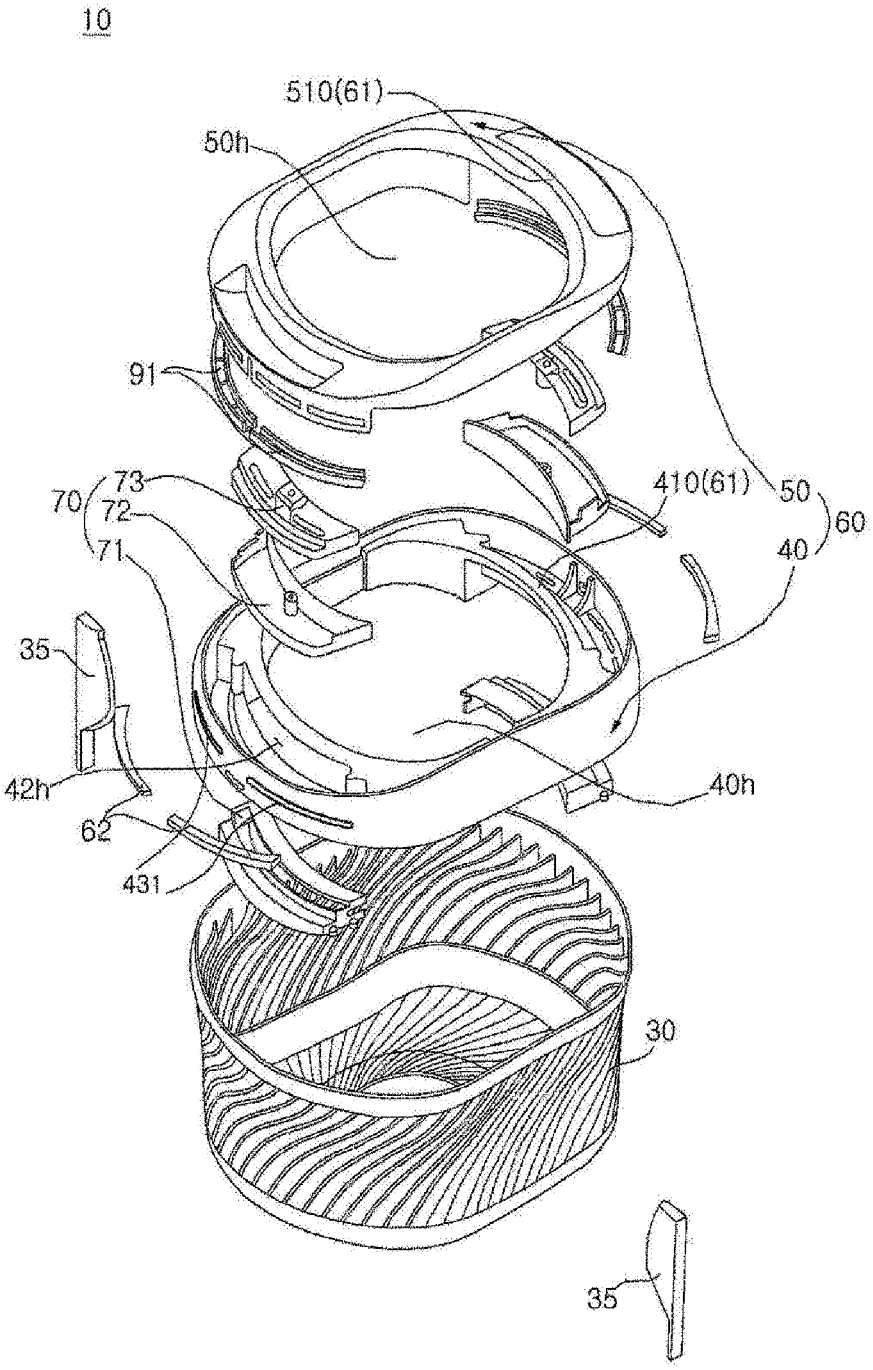
FIG. 3 is an exploded perspective view of the second washing tub.

Meanwhile, referring to FIG. 3, a vane 35 may be provided on the inner surface of the container 30 to extend long in a vertical direction. The vane 35 protrudes from the inner surface of the container 30. The vane may be manufactured separately from the container 30, and then installed in the container 30. After the water stream generated by the rotation of the second washing tub 10 is moved upwards by collision with the vane 35, the water stream drops to the central portion of the container 30. A plurality of vanes 35 may be provided. Preferably, the plurality of vanes is disposed to be symmetrical with respect to the rotation center of the second washing tub 10*a*. In an embodiment, a pair of vanes 35 is provided, but the number of the vanes 35 should not be limited thereto.

The washing-tub cover 60 may include a handle 61 formed around the laundry feed opening 60*h*. When seeing the washing-tub cover 60 from top to bottom, the laundry feed opening 60*h* is located on a first side of the handle 61, and the water supply port 51*h* is located on a second side thereof. The handles 61 may be provided on both sides of the laundry feed opening 60*h*, respectively, and the water supply port 51*h* may be likewise provided on the second side of each handle 61.

The sub dispensers 70 may be provided on both sides of the washing-tub cover 60, respectively. In this case, the washing detergent or the bleach may be supplied through any one of the pair of sub dispensers 70, while the fabric softener may be supplied through the other sub dispenser.

The sub dispenser 70 may be provided on the lower cover 40. The sub dispensers 70 may be disposed at positions corresponding to a pair of water supply ports 51*h*, respectively. Hereinafter, the pair of sub dispensers 70 are divided into a first sub dispenser 70(1) and a second sub dispenser 70(2).

Depending on the rotation position (or rotation angle) of the second washing tub 10, water discharged from the main dispenser 16 may be selectively supplied to the first sub dispenser 70(1) or the second dispenser 70(2). For example, the rotation position (or rotation angle) of the second washing tub 10 may be controlled by the controller so that water is supplied to the first sub dispenser 70(1) in a wash cycle, and water is supplied to the second sub dispenser 70(2) in a rinse cycle.

Each sub dispenser 70 may include a dispenser housing 71, a drawer 72 that is retractably received in the dispenser housing 71 and is opened at a top thereof, and a drawer cover 73 that covers the opened top of the drawer 72. The drawer cover 73 may be detachably coupled to the drawer 72. An opening 73*h* through which water discharged from the main dispenser 16 passes is formed in the drawer cover 73, so that water passing through the opening 73*h* is fed into the drawer 72.

The upper cover 50 may include a flow guide 52 that guides water introduced through the inlet 51*h* to the sub dispenser 70. The flow guide 52 has an inclined surface to guide water downwards, and water guided along the inclined surface is guided to the opening 73*h* of the drawer cover 73.

A plate 55 may be provided in the upper housing 50 to be fixed to an upper side of the sub dispenser 70. The plate 55 may be removably attached to the upper housing 50. A gap 55*h* is formed between the plate 55 and a lower end of the flow guide 52, and water guided along the flow guide 52 passes through the gap 55*h* to be supplied to the opening 73*h* of the drawer cover 73.

The dispenser housing 71 may provide a space in which the drawer 72 is accommodated, and may be coupled to the lower cover 40. The dispenser housing 71 may be fastened to the lower cover 40 by a fastening member such as a screw or a bolt.

The drawer 72 may be a container opened at a top thereof, and the additive may be contained in the drawer 72. The drawer 72 is coupled to the dispenser housing 71. Such a coupling allows the drawer 72 to be inserted into the dispenser housing 71 or to be taken out from the dispenser housing 71. In an embodiment, the drawer 72 is pivotably coupled to the dispenser housing 71. To be more specific, the drawer is hinged to the dispenser housing 71. However, the present disclosure is not limited thereto. For example, the drawer may be coupled to the dispenser housing 71 to be slidable relative thereto.

Referring to FIG. 7, the drawer 72 may include the siphon pipe 724 that protrudes upwards from the bottom, and the drawer cover 73 may include a siphon cap 732 that covers the siphon pipe 724.

The exit of the siphon pipe 724 is formed in the bottom of the drawer 72, and a flow path having an annular cross-section is formed between the siphon cap 73 and an outer circumferential surface of the siphon pipe 724. Such a structure is suitable to supply the liquid additive.

If water is supplied to the sub dispenser 70 and thus a water level in the drawer 72 rises gradually, water moves upwards along the flow path having the annular cross-section and thus flows through an entrance of an upper end of the siphon pipe 724 into the siphon pipe 724. Subsequently, the water is discharged through the exit of a lower end of the siphon pipe 724 to the container 30.

Meanwhile, in order to simultaneously wash the laundry in the first washing tub 6 and the laundry in the second washing tub 10, water should be supplied to the first washing tub 6 in a state where the second washing tub 10 is installed. Hereinafter, a method of supplying water to the first washing tub 6 in a state where the second washing tub 10 is installed will be described.

Referring to FIG. 6, when viewed from above, the appearance of the second washing tub 10 may include a first section 51 that is in contact with the support 22 of the balancer 20, and a second section S2 that is spaced apart from the support 22.

The first section S1 may be located on a first axis (line shown by VII-VII) that passes through the vertical axis O, and the second section S2 may be located on a second axis Y that passes through the vertical axis O and is perpendicular to the first axis. The first sections S1 may be formed on both sides to be symmetrical with respect to the second axis Y, while the second sections S2 may be formed on both sides to be symmetrical with respect to the first axis.

When the second washing tub 10 is rotated to be aligned in a first rotation position by controlling the driver 8 with the controller, water discharged from the main dispenser 16 may be supplied into the container 30 through gaps formed between the second sections S2 and the inner circumferential surface of the balancer 20.

When the second washing tub 10 is rotated at a predetermined angle from the first rotation position to be aligned in a second rotation position by controlling the driver 8 with the controller, water discharged from the main dispenser 16 is supplied through the water supply port 51*h* to the sub dispenser 70. That is, when the second washing tub 10 is in the second rotation position, the water supply port 51*h* is aligned with the exit of the main dispenser 16, so that the water discharged through the exit is introduced into the water supply port 51*h*. In an embodiment, the second rotation position is a position where the first washing tub 6 is rotated by 90 degrees from the first rotation position. However, when the position of the water supply port 51*h* is changed according to an embodiment, an angle between the second rotation position and the first rotation position may be changed. As described above, since the washing motor may control speed, the controller may control the rotation angle of the first washing tub 6 or the rotation position of the first washing tub 6, based on the speed of the washing motor. Since the second washing tub 10 is rotated integrally with the first washing tub 6, the control of the rotation angle or the rotation position of the first washing tub 6 leads to the control of the rotation angle or the rotation position of the second washing tub 10.

To be more specific, a first hall sensor (not shown) may be provided on the water-storage-tub cover 14, and a first magnet may be provided on the second washing tub 10. During the rotation of the second washing tub 10*a*, the first hall sensor may be configured to sense a magnetic field generated by the first magnet and to send a signal to the controller on the basis of the sensed magnetic field. The controller may identify the rotation speed, the rotation position (or position of the first magnet), and the rotation angle of the second washing tub 10 on the basis of the received signal, and may control the washing motor so that the first washing tub 6 is aligned in the first rotation position or the second rotation position on the basis of the identified value.

Meanwhile, the second magnet may be provided on a rotor of the washing motor, and a second hall sensor may be disposed on a fixed structure (e.g. bottom of the water storage tub 4) in the vicinity of the second magnet that senses the magnetic field generated by the second magnet. A plurality of second magnets may be disposed along the periphery of the rotor. The controller may control the washing motor on the basis of the signal output from the second hall sensor. Here, by considering the signal output from the above-described first hall sensor together, the second washing tub 10 may be controlled to be aligned in the first rotation position or the second rotation position.

According to an embodiment, the rotation angle of the rotor may be sensed without a separate sensor. In other words, the controller may sense the rotation angle of the rotor in a sensorless method. For example, after the phase current of a predetermined frequency flows through the washing motor, the position of the rotor of the washing motor may be estimated on the basis of the output current that is detected while the current of the predetermined frequency flows through the washing motor. Since such a sensorless method is known to those skilled in the art, a detailed description thereof will be omitted.

Meanwhile, after water has been supplied into the container 30, the controller controls the driver 8 according to a preset algorithm to perform a washing operation. Subsequently, water used for washing laundry should be discharged from the second washing tub 10. The drainage is performed using the centrifugal force caused by the high-speed rotation of the second washing tub 10.

To be more specific, referring to FIG. 12, the inlet 452*h* and the outlet 431 are formed in the lower cover 40. The water stream moved upwards in the container 30 by the centrifugal force when the second washing tub 10*a* rotates is introduced into the inlet, and the water introduced through the inlet 452*h* is discharged through the outlet 431. Although omitted in FIG. 12 but shown in FIG. 2, the nozzle 62 may be inserted into the outlet 431.

The lower cover 40 may include a bottom portion 452 into which the inlet 452*h* is formed, and a sidewall portion 43*a* which extends upwards from the bottom portion 452 and in which the outlet 431 is formed. The lower cover 40 may include a first top portion 41 into which the first opening 40*h* is formed, a first inner-wall portion 42 extending downwards from the first top portion 41 around the first opening 40*h*, and an outer-wall portion 43 extending along an outer periphery of the first top portion 41.

A portion of the first top portion 41 is depressed to form a groove 45. In this case, the bottom portion 452 forms the bottom surface of the groove 45. The sidewall portion 43*a* belongs to the outer-wall portion 43, and forms an external inner circumferential surface 451 of the groove 45. The opening 42*h* may be formed in the first inner-wall portion 42 to install the dispenser 70 therein.

Referring to FIGS. 9, 12, and 13, the lower cover 40 may include an internal handle 410 formed between the groove 45 and the first opening 40*h*. A first side surface of the internal handle 410 may be formed by the first inner-wall portion 42. In this case, the first side surface defines the first opening 40*h*. The opening 42*h* for installing the dispenser 70 is formed in the first side surface, and the opening 42*h* is formed to be higher than the dispenser 70, so that a space is formed between the dispenser 70 and the internal handle 410 to allow a user's finger to pass therethrough when the user grips the handle 61.

Meanwhile, the groove 45 has an internal inner circumferential surface 453 that is formed to be radially spaced apart from the external inner circumferential surface 451. The internal inner circumferential surface 453 is located opposite to the external inner circumferential surface 451, and extends upwards from the bottom of the groove 45.

Both ends of the internal inner circumferential surface 453 are connected to the external inner circumferential surface 451 by groove inner surfaces 454 and 455, and thus an inside surrounded by the internal inner circumferential surface 453, the first groove inner surface 454, the second groove inner surface 455, and the external inner circumferential surface 451 is an area defined by the groove 45.

The inclined surface 456 may extend inwards in the radial direction from the upper end of the internal inner circumferential surface 453. In order to prevent water from penetrating a gap between the inclined surface 456 and the flow guide 52 of the upper cover 50, the inclined surface 456 is preferably in contact with the bottom of the flow guide 52.

The internal inner circumferential surface 453 is connected to the outer-wall portion 43 by a pair of partition walls 47 and 48. The locking member 81 that will be described below is preferably in contact with the internal inner circumferential surface 453 by the restoring force of a spring 82 in an unlock position (i.e. position of the locking member 81 when the second washing tub 10 is stopped).

The upper cover 50 may include a second top portion 51 in which the second opening **50*h* and the water supply port 51*h* are formed, and a second inner-wall portion 53 which extends downwards from the second top portion 51 around the second opening 50*h*. The water supply port 51*h* is located outside the second opening 50*h*** in the radial direction.

The second top portion 51 may include an external handle 510 formed between the water supply port **51*h* and the second opening 50*h*. The external handle 510 may include a handle top portion 511 that belongs to the second top portion 51, a first handle side portion 512 that extends downwards from the handle top portion 511 around the second opening 50*h* and belongs to the second inner-wall portion 53, and a second handle side portion 513 that extends downwards from the handle top portion 511 around the water supply port 51*h*. In other words, an "U"-shaped groove that is opened at a bottom is formed by the handle top portion 511, the first handle side portion 512, and the second handle side portion 513**.

The internal handle 410 is inserted into the "U"-shaped groove. A user can hold both the internal handle 410 and the external handle 510, so that the upper cover **50*a* and the lower cover 40*a* are not separated from each other when the second washing tub 10*a*** is lifted.

In order to more firmly couple the internal handle 410 and the external handle 510, a hook (not shown) may be formed on any one of the internal handle 410 and the external handle 510, and a catch groove (not shown) in which the hook is caught may be formed in the remaining one of the internal handle and the external handle.

Meanwhile, the opening **53*h* may be formed in the second inner-wall portion 53 of the upper cover 50 to correspond to a position of the opening 42*h* of the lower cover 40*a*. The first handle side portion 512 of the external handle 510 may be formed by the second inner-wall portion 53. In this case, the first handle side portion 512 defines the second opening 50*h***.

The height of the opening **53*h* is determined by the lower end of the first handle side portion 512. The lower end of the first handle side portion 512 may be substantially at the same height as the lower end of the second handle side portion 513**.

Meanwhile, the flow guide 52 may be formed on the upper cover 50 to extend around the water supply port **51*h*, especially from a section located opposite the second handle side portion 513. In other words, the flow guide 52 extends from the second top portion 51, at a position that is spaced apart from the second handle side portion 513 outwards in the radial direction. The flow guide 52 extends gradually downwards as it goes inwards along the radial direction from the second top portion 51**.

Meanwhile, referring to FIG. 12, the flow path FP may be formed in the washing-tub cover 60 to extend from the inlet **452*h* to the outlet 431. If the second washing tub 10 is rotated, the water stream developed outwards along the radial direction by the centrifugal force in the container 30 moves upwards along the inner surface of the container 30. After the water stream moved upwards as such flows through the inlet 452*h* into the flow path FP, the water stream is discharged through the outlet 431. As described above, the inlet 452*h* and the outlet 431 are formed in the lower cover 40*a*, and the upper cover 50 is combined with the lower cover 40** to define the flow path FP.

The flow path FP may be defined as an area formed by the bottom portion 452, the outer-wall portion 43, and the first inner-wall portion 42 of the lower cover 40. The water introduced through the inlet **452*h* into the flow path FP is moved upwards along the inner surface of the sidewall portion 43*a* (i.e. external inner circumferential surface 451) and then is discharged through the outlet 431. At this time, the remaining water that is not discharged through the outlet 431 is not moved upwards by the bottom of the upper cover 50. When the capacity of the flow path FP is sufficient, most of the water in the flow path FP is compressed against the external inner circumferential surface 451 by the centrifugal force, so that the water stream reaching up to the internal inner circumferential surface 453 is not substantially generated. Therefore, according to an embodiment, the internal inner circumferential surface 453** may not contribute to the role of defining the flow path FP.

The check valve 91 may be further provided on the lower cover 40 to open or close the inlet **452*h*. The check valve 91 may be configured to be opened or closed by the centrifugal force generated by the rotation of the second washing tub 10** or to be opened or closed by water pressure.

The check valve 91 may be disposed in the groove 45. A bottom of the check valve 91 may be in close contact with the top of the bottom portion 452 (i.e. bottom surface of the groove 45), an outer end **91*a* thereof may be fixed to the bottom portion 452, and an inner end 91*b* located at an inner position than the outer end 91*a* along the radial direction may be rotated about the outer end 91*a*. In order to fix the outer end 91*a*, a rib (not shown) for pressing the top of the check valve 91 may protrude from the bottom of the upper cover 50**.

The check valve 91 may be made of a material having some elasticity, such as rubber. In this case, the check valve 91 is rotated by the pressure of the water stream passing through the inlet **452*h*, and moment generated by the centrifugal force with the outer end 91*a* as an action point, thus opening the inlet 452*h*. If the second washing tub 10 is stopped or decelerated, the check valve returns to its original position by its own weight and the restoring force of the material, thus closing the inlet 452***h*.

However, without being limited thereto, according to an embodiment, the outer end 91*a* may be rotatably connected to the bottom portion 452, so that the check valve 91 may pivot about a portion in which the outer end 91 and the bottom portion 452 are connected. In this case, the check valve 91 may be made of an inelastic material.

A wash course using the second washing tub 10 may include a wash cycle and a drain cycle. In the wash cycle, the rotating speed of the second washing tub 10 is preferably set such that the water stream in the container 30 does not reach the inlet 452*h*. At this time, the rotating speed of the second washing tub 10*a* may be changed according to the water level in the container 30. However, according to an embodiment, in the case where the quantity of water supplied to the container 30 is configured to be always constant in the wash cycle, the rotation speed of the second washing tub 10 may be determined by an experiment when the water stream starts to reach the inlet 452*h*, on the basis of a case where a preset fixed quantity (i.e. an input quantity reported to a user through product instructions or the like) of cloth is put. In order not to exceed the rotation speed determined in this manner, the controller may control the rotating speed of the second washing tub 10 in the wash cycle.

Otherwise, the rotation speed of the second washing tub 10 in the wash cycle may be controlled, within a range where the water pressure acting through the inlet 452*h* does not overcome the moment acting in a direction where the inlet is closed by the own weight of the check valve 91, even if the water stream moved upwards in the container 30 reaches the inlet 452*h*.

Referring to FIGS. 7, 11, and 13, the washing machine according to an embodiment of the present disclosure includes a locking member 81 that is provided on the second washing tub 10 and secures the second washing tub to prevent it from being removed from the first washing tub 6 during the rotation of the second washing tub 10. The locker 80 may be provided on the lower cover 40.

The locker 80 may include a locking member 81 and an elastic member 82. The locking member 81 is located in the first position (see FIG. 13(*a*), hereinafter referred to as the unlock position) in a state where the second washing tub 10 is stopped, and is moved from the first position to a second position (see FIG. 13(*b*), hereinafter referred to as the lock position) by the centrifugal force when the second washing tub 10 is rotated. The lock position is outside the unlock position in the radial direction.

The locking member 81 engages with the first washing tub 6 in the lock position to secure the second washing tub 10 to the first washing tub 6. A straight line connecting from the unlock position to the lock position (i.e. a moving line of the locking member 81) may cross the first section 51 (see FIG. 6).

A locking groove 22*r* into which the locking member 81 is inserted in the lock position may be formed in the balancer 20. The locking groove 22*r* may be formed in the inner-diameter portion of the balancer body 21. If the second washing tub 10 is mounted on the ring-shaped balancer 20 and is rotated at a predetermined speed or higher while being aligned in a preset rotation position, the locking member 81 is moved outwards in the radial direction by the centrifugal force to reach the lock position. In this process, the locking member 81 is inserted into the locking groove 22*r*. Even if the second washing tub 10 is shaken or vibrated during the rotation, the removal of the second washing tub 10 is prevented because the locking member 81 and the locking groove 22*r* engage with each other. Particularly, since the upward movement of the second washing tub 10 is restrained, the second washing tub 10 does not collide with the top cover 3 or a door (not shown). Even when the second washing tub 10 is rotated at high speed (e.g. a spin-dry cycle), damage to devices may be prevented, and accidents may also be prevented.

Since the second washing tub 10 is locked not by a separate power mechanism (e.g. motor) but by the centrifugal force that is generated by the rotation of the second washing tub 10, it has advantages in that a lock structure is simplified and it is unnecessary to provide a special control for the lock.

The elastic member 82 is elastically deformed when the locking member 81 is in the lock position, and is restored to its original state when the second washing tub 10 stops rotating, so that the locking member 81 returns to the unlock position. If the second washing tub 10 stops rotating, the locking member 81 is restored to the unlock position by the restoring force of the elastic member, so that the lock is automatically released. If the washing operation is completed, the lock is automatically released, so that the second washing tub 10*a* may be easily lifted without a user performing a separate operation for releasing the lock.

The elastic member 82 may be a coil spring that is compressed when the locking member 81 moves from the unlock position to the lock position. The locking member 81 may include a spring mount 81*b* that is elastically biased by the spring 82, and a head 81*a* that protrudes from the spring mount 81*b*. The spring mount 81*b* may include spring fixing projections 81*c* and 81*d* formed on both protruding portions of the head 81*a*, and a pair of springs 82 may be fitted over the fixing projections 81*c* and 81*d*. In other words, the first end of the spring 82 may be located on the inner surface (i.e. external outer circumferential surface 451) of the outer-wall portion 43, and the second end thereof may elastically bias the spring mount 81*b*. A pair of projections (not shown) may protrude from the external inner circumferential surface 451 of the groove 45, so that the first end of the spring 82 may be fitted over each of projections 435*a* and 435*b*.

In the unlock position, the locking member 81 may come into contact with the internal inner circumferential surface 453 of the groove 45 by the restoring force of the spring 82. In the unlock position, the locking member 81 may be stably maintained without being shaken.

Referring to FIGS. 2 and 11, the lower cover 40 may have a first penetration part 432 formed on the outer-wall portion 43. The head 81*a* may be located within the first penetration part 432. Preferably, even if the locking member 81 is located at any point between the unlock position and the lock position, the head 81*a* is always located in the first penetration part 432.

Meanwhile, the container 30 may include the container body 31, and a rim portion 32 (see FIGS. 2 and 12) that is formed on the upper end of the container body 31 and surrounds the outer-wall portion 43 outside the lower cover 40. The rim portion 32 may be formed on the upper end of the container body 31, namely, along the circumference of the opening in the top of the container 30. A second penetration part 32*h* may be formed on the rim portion 32 to communicate with the first penetration part 432. The head 81*a* passes through the second penetration part 32*h* to protrude out of the second washing tub 10.

The head 81*a* may include an insert portion 811 that is inserted into the locking groove 22*r*, and a catch portion 812 that is a portion connecting the insert portion 811 and the spring mount 81*b*, with a portion connected with the spring mount 81*b* having a sectional area that is larger than a passage area of the first penetration part 432. The insert portion 811 may pass through the first penetration part 432, whereas the catch portion 812 may not pass therethrough.

A section of the head 81*a* taken along a plane perpendicular to the longitudinal direction (i.e. a moving line of the locking member 81) has a rectangular shape. The first penetration part 432 may be formed such that an exit located on the outer surface of the outer-wall portion 43 corresponds to a section of the insert portion 811, and an entrance located on the inner surface of the outer-wall portion 43 corresponds to a section of the catch portion 812. The catch portion 812 may include a first inclined surface 812*a* (see FIG. 13) that gradually extends downwards from the portion connected to the spring mount 81*b* towards the insert portion 811. A second inclined surface 432*a* corresponding to the first inclined surface may be formed between the entrance and the exit of the first penetration part 432.

A pair of partition walls 47 and 48 is formed on the lower cover 40. A space SP is provided between the pair of partition walls 47 and 48 to accommodate a locker 80 therein. The space SP is separated from the flow path FP by the pair of partition walls 47 and 48. Each of the partition walls 47 and 48 may extend from the bottom portion 452 to the outer-wall portion 43. Furthermore, each of the partition walls 47 and 48 is connected to the internal inner circumferential surface 453. In other words, the space SP is surrounded by the outer-wall portion 43, the pair of partition walls 47 and 48, and the internal inner circumferential surface 453, and is opened at its top. The opened top is closed again by the bottom of the upper cover 50.

Particularly, the upper ends of the partition walls 47 and 48 come into close contact with the bottom of the upper cover 50, thus preventing water contained in the flow path FP from overflowing the partition walls 47 and 48 and flowing into the space SP. The bottom of the flow guide 52 may come into close contact with the upper ends of the partition walls 47 and 48.

In an embodiment, in order to more reliably maintain air-tightness between the partition walls 47 and 48 and the upper cover 50, a sealer (not shown) may be provided to seal gaps between the upper ends of the pair of partition walls 47 and 48 and the bottom of the upper cover 50. The sealer is made of a soft material (e.g. rubber) to be interposed between the pair of partition walls 47 and 48 and the bottom of the upper cover 50. In this case, one surface of the sealer is pressed by the partition walls 47 and 48, while the other surface is pressed by the bottom of the upper cover 50.

Figure 16:
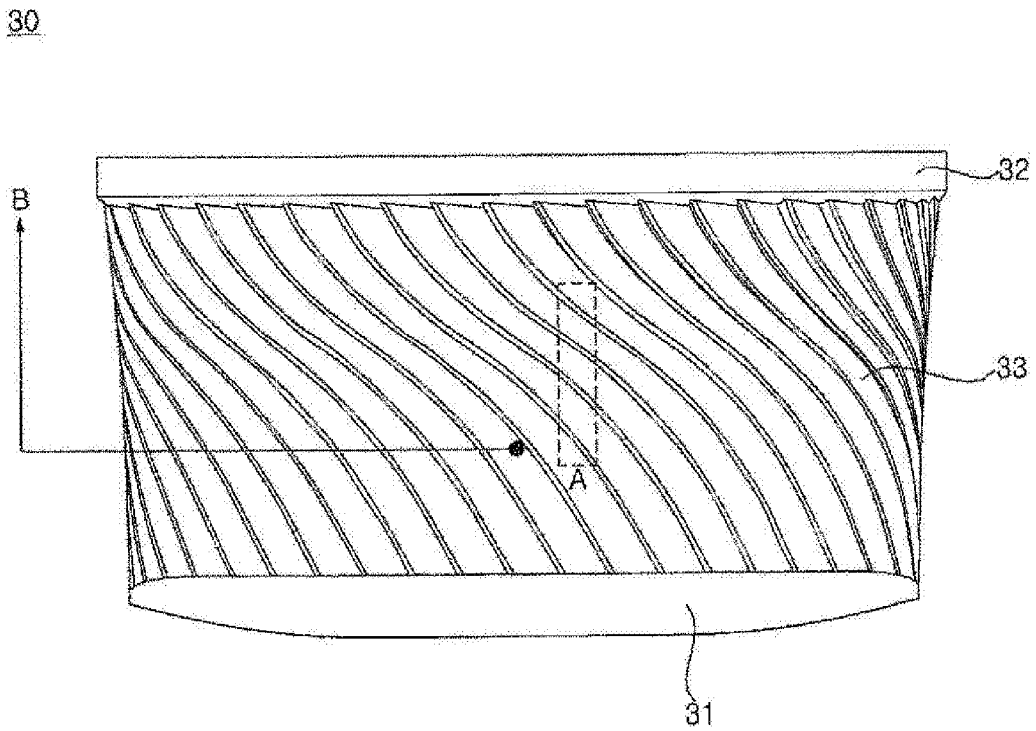
Figure 17:
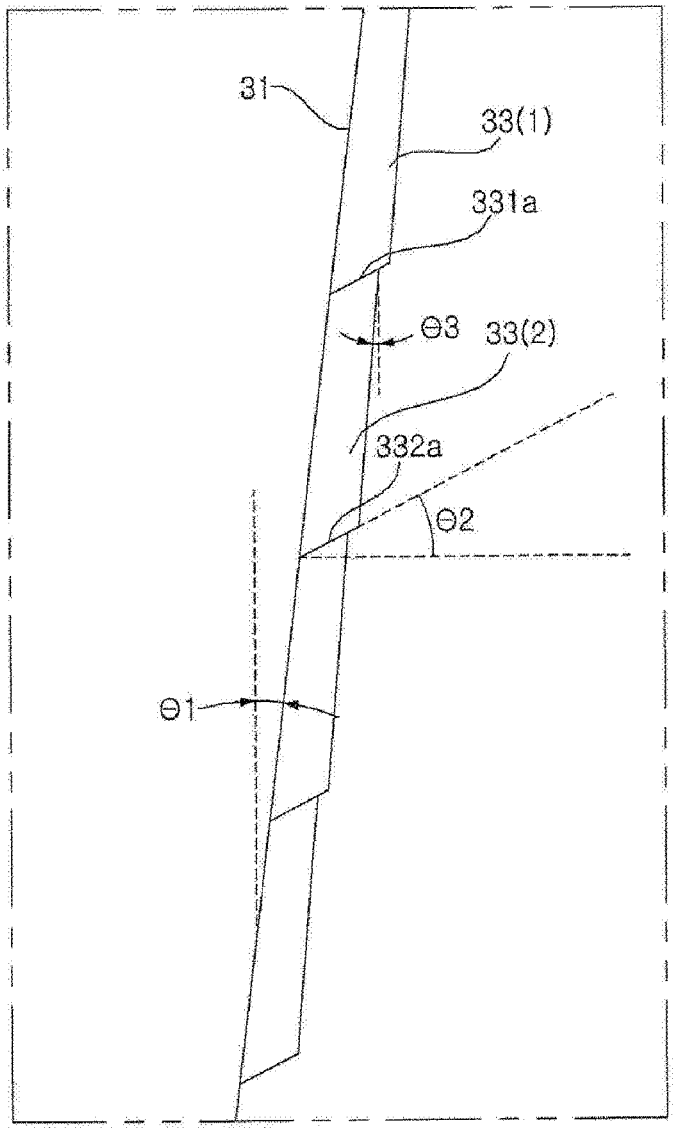
FIG. 17 is an enlarged view of portion A in FIG. 16.
Figure 18:
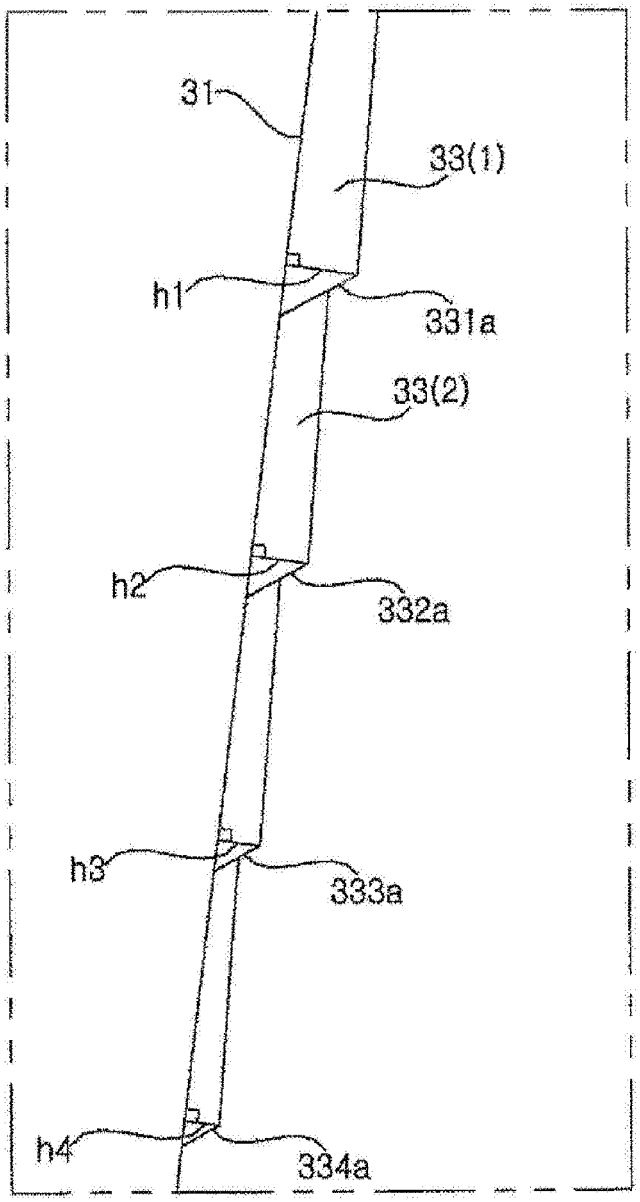
FIG. 18 is an enlarged view of a portion of a container in accordance with another embodiment of the present disclosure.
Figure 19:
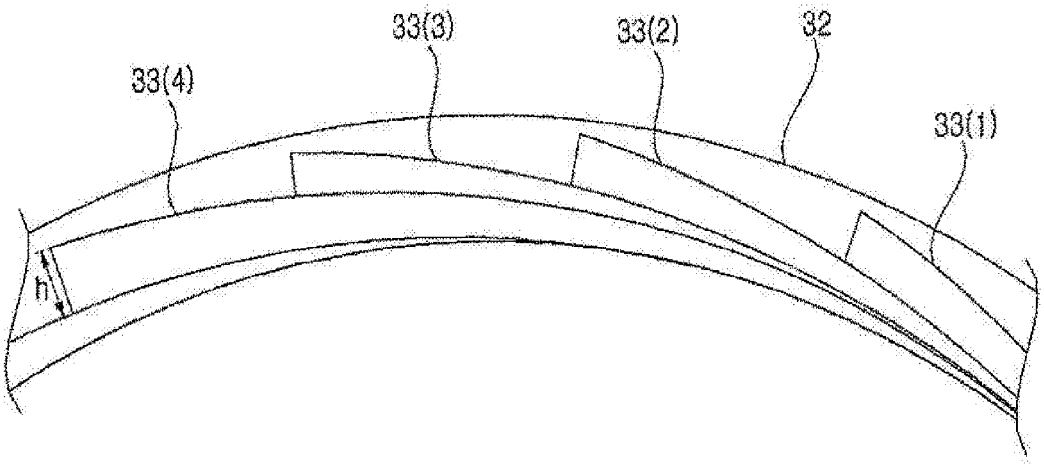
FIG. 19 is a diagram when viewed in direction B shown in FIG. 17.
Figure 20:
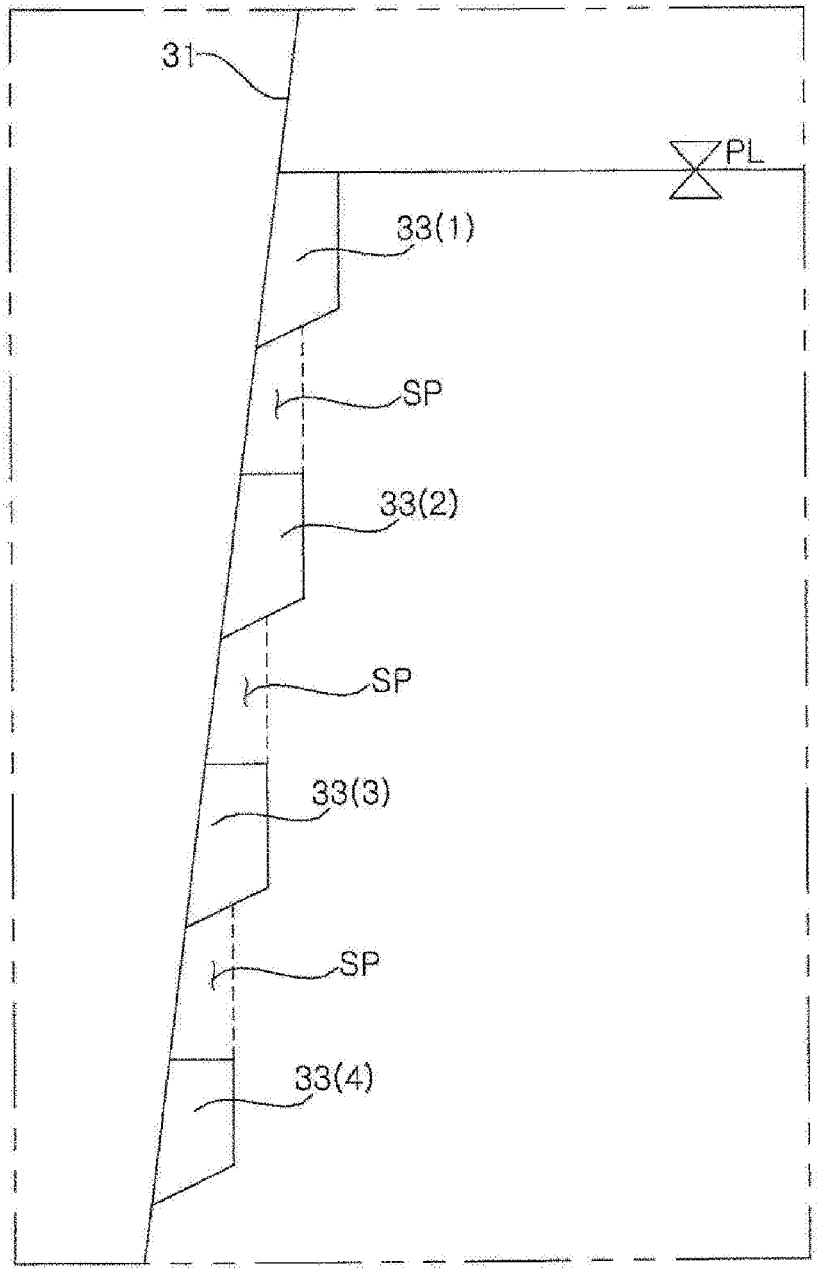
FIG. 20 is an enlarged view of a portion of a container in accordance with a comparative example.

FIG. 16 is a side view of a container. FIG. 17 is an enlarged view of portion A in FIG. 16. FIG. 18 is an enlarged view of a portion of a container in accordance with another embodiment of the present disclosure. FIG. 19 is a diagram when viewed in direction B shown in FIG. 17. FIG. 20 is an enlarged view of a portion of a container in accordance with a comparative example.

Referring to FIG. 16, a plurality of threads 33 protrudes from the outer surface of the container body 31. The threads 33 may extend spirally or diagonally to form a multiple row structure. Lower surfaces 331*a*, 332*a*, 333*a*, and 334*a* of the threads 33(1), 33(2), 33(3), and 33(4) protrude from the outer surface, and the lower surfaces 331*a*, 332*a*, 333*a*, and 334*a* form multiple rows (see FIGS. 17 and 18).

Hereinafter, among the plurality of threads 33, a pair of adjacent threads 33(1) and 33(2) is selected. Among the two treads, a thread located at an upper position is defined as a first thread 33(1), and the other thread is defined as a second thread 33(2).

The second thread 33(2) is formed by upwards extruding the lower surface 332*a* of the second thread 33(2) and then connecting it to the lower surface 331*a* of the first thread 33(1). That is, the second thread 33(2) has a shape of connecting the lower surface 331*a* of the first thread 33(1) and the lower surface 332*a* of the second thread 33(2). Hereinafter, the lower surface 331*a* of the first thread 33(1) is designated as a first lower surface 331*a*, and the lower surface 332*a* of the second thread 33(2) is designated as a second lower surface 332*a*

As illustrated in FIG. 20, if the thread 33(2) located at a lower position is not connected to the thread 33(1) located at an upper position, a gap SP may be formed between the adjacent threads 33(1) and 33(2). In this case, when the container body 31 is injection-molded using an upper mold and a lower mold with respect to a parting line PL, the undercut is generated.

Therefore, in order to prevent the undercut, the lower surface of the thread 33(2) located at the lower position extrudes to be connected to the lower surface of the thread 33(1) located at the upper position, thus filling the gap between the adjacent threads 33(1) and 33(2).

The outer surface of the container body 31 may be inclined to gradually approach the vertical axis O in the direction from top to bottom. An angle between the outer surface of the container body 31 and the vertical axis is denoted by θ1 in FIG. 17.

The lower surface 331*a*, 332*a*, 333*a*, or 334*a* of each thread (33(1), 33(2), 33(3), or 33(4) may be inclined to be gradually distant from the vertical axis O in the direction from the bottom to the top. An angle between the lower surface of the thread 33 and the horizontal axis is denoted by θ2 in FIG. 17. When the second washing tub 10 is mounted on the balancer 20, the threads 33 may smoothly engage with the engagement groove 22*c* formed in the balancer 20 due to the inclination of the lower surface.

An outer circumferential surface of the second thread 33(2) is defined as a curved surface extending from a periphery of the first lower surface 331*a* to a periphery of the second lower surface 332*a*. The outer circumferential surface may be inclined to gradually approach the vertical axis O in the direction from top to bottom. An angle between the outer circumferential surface and the vertical axis is denoted by θ3 in FIG. 8. Particularly, the angle between the outer circumferential surface and the vertical axis allows a molded product to be easily taken out from the lower mold.

Referring to FIG. 19, the height of each thread 33 protruding from the outer surface of the container body 31 may be gradually reduced in a direction from the upper end of the thread 33 to a lower end. That is, it can be seen from FIG. 19 that the height at the upper end of each thread 33 is h but is gradually reduced towards the lower end.

As illustrated in FIG. 16, when viewing the container body 31 in a horizontal direction to observe the heights of the threads 33 protruding from the outer surface of the container body 31, a height h2 of the second thread 33(2) protruding from the outer surface may be lower than a height h1 of the first thread 33(1) protruding from the outer surface (h1>h2). Such a relationship may be applied to all threads that are adjacent to each other. (h1>h2>h3>h4 . . . )

Since such a structure in which the height of the thread 33 is reduced towards the lower end allows each thread 33 to have a wedge shape, the thread 33 firmly engages with the engagement groove 22*c*.

Although the present disclosure was described with reference to specific embodiments, it is apparent to those skilled in the art that the present disclosure may be changed and modified in various ways without departing from the scope of the present disclosure, which is described in the following claims.

What is claimed is:

1. A washing machine, comprising:

a drum configured to rotate about a vertical axis, the drum having an opening defined at an upper end of the drum;

a balancer that has a ring shape and that is coupled to the upper end of the drum, the balancer having (i) a circular opening defined by an inner circumferential surface of the balancer and (ii) a plurality of engagement grooves defined at the inner circumferential surface of the balancer; and a container inserted into the circular opening of the balancer and detachably coupled to the balancer, the container being configured to receive laundry and to rotate based on rotation of the drum, wherein the container comprises:

a container body that has a container opening defined at a top of the container, and that is configured to receive the laundry therein, and a plurality of threads that are disposed on an outer circumferential surface of the container body and that have a helical shape extending upward in a circumferential direction along the outer circumferential surface of the container body, wherein each of the plurality of threads comprises:

a crest surface that extends along the helical shape, a first surface that extends from a first end of the crest surface, the first end having a first height radially outward with respect to the outer circumferential surface of the container body, and a second surface that extends from a second end of the crest surface, the second end having a second height radially outward with respect to the outer circumferential surface of the container body, and wherein the first height is less than the second height.

2. The washing machine of claim 1, wherein the helical shape comprises an inflection point.

3. The washing machine of claim 1, wherein the outer circumferential surface of the container body is inclined to gradually approach the vertical axis in a direction from a top of the container body to a bottom of the container body.

4. The washing machine of claim 1, wherein the container further comprises:

a rim portion that is disposed at the upper end of the container body, and a washing-tub cover that is coupled to the rim portion and that defines a cover opening configured to introduce the laundry into the container.

5. The washing machine of claim 1, wherein the plurality of threads include a first thread and a second thread that are adjacent to each other, the second thread being located under the first thread, wherein the first end of the crest surface of the second thread is connected to the second surface of the first thread, and wherein the second end of the crest surface of the second thread is located below the first end of the crest surface of the second thread and located radially outward relative to the first end of the crest surface.

6. The washing machine of claim 5, wherein the second surface of each of the first thread and the second thread is inclined to be gradually distant from the vertical axis in a direction from a bottom of the container body to a top of the container body.

7. The washing machine of claim 5, wherein the outer circumferential surface of the container body is inclined to gradually approach the vertical axis in a direction from a top of the container body to a bottom of the container body.

8. The washing machine of claim 7, wherein a height of the second thread protruding from the outer circumferential surface of the container body is less than a height of the first thread protruding from the outer circumferential surface of the container body.

9. The washing machine of claim 5, wherein the first surface of each of the first thread and the second thread is inclined to be gradually distant from the vertical axis in a direction from a top of the container body to a bottom of the container body.

10. The washing machine of claim 5, further comprising:

a washing-tub cover that is coupled to the top of the container body and that defines a cover opening configured to introduce the laundry into the container body.

11. The washing machine of claim 1, wherein a difference between the second height and the first height defines a thread depth of each of the plurality of threads, the thread depth increasing from a lower end to an upper end of each of the plurality of threads.

12. The washing machine of claim 1, wherein the second surface extends from the outer circumferential surface of the container body to the second end of the crest surface, and wherein the second surface is inclined with respect to the outer circumferential surface of the container body and the vertical axis.

13. The washing machine of claim 1, wherein the second surface of one of the plurality of threads faces and is in contact with the first surface of another of the plurality of threads.

14. The washing machine of claim 1, wherein each of the first surface and the second surface is inclined with respect to the outer circumferential surface of the container body and the vertical axis, and wherein the second end of the crest surface is located vertically below the first end of the crest surface and radially outward relative to the first end of the crest surface.

* * * * *